US011203221B1

(12) United States Patent
Foegelle

(10) Patent No.: US 11,203,221 B1
(45) Date of Patent: Dec. 21, 2021

(54) LABEL BOOK CONTAINING PRINTED STORE LABELS FOR USE ALONG A RETAIL SHELF EDGE

(71) Applicant: Elite Creative Solutions, LLC, Broken Arrow, OK (US)

(72) Inventor: John Foegelle, Broken Arrow, OK (US)

(73) Assignee: Elite Creative Solutions, LLC, Broken Arrow, OK (US)

( * ) Notice: Subject to any disclaimer, the term of this patent is extended or adjusted under 35 U.S.C. 154(b) by 0 days.

(21) Appl. No.: 17/020,197

(22) Filed: Sep. 14, 2020

Related U.S. Application Data

(63) Continuation-in-part of application No. 16/752,786, filed on Jan. 27, 2020, now Pat. No. 10,777,099, (Continued)

(51) Int. Cl.
*B42D 5/00* (2006.01)
*B42D 1/00* (2006.01)
*G09F 3/02* (2006.01)

(52) U.S. Cl.
CPC ..... *B42D 5/002* (2013.01); *B42D 1/001* (2013.01); *B42D 1/004* (2013.01); *G09F 3/02* (2013.01);
(Continued)

(58) Field of Classification Search
CPC . B42D 1/004; B42D 5/002; G09F 2003/0201; G09F 2003/0205;
(Continued)

(56) References Cited

U.S. PATENT DOCUMENTS 1,927,266 A 9/1933 Huttner
4,193,498 A 3/1980 Rowling
(Continued)

FOREIGN PATENT DOCUMENTS

CH 140735 A 6/1930
FR 1226001 A 7/1960
(Continued)

OTHER PUBLICATIONS

Nexgenpackaging.com, "page from website", "in-plant printing", , Publisher: https://www.nexgenpackaging.com/.
(Continued)

*Primary Examiner* — Kyle R Grabowski
(74) *Attorney, Agent, or Firm* — GableGotwals

(57) ABSTRACT

Embodiments of a store label booklet include a plurality of sheets stacked one on top of the other and connected to a binding that spans an entire thickness of the booklet, each sheet including a planar array of store labels. No release coating is used. When each store label or row is removed from the book, a liner strip remains connected to the binder and a portion of the adhesive lying opposite the liner strip is exposed for application of the label to a retail shelf edge. Each store label may differ in orientation, size, or style and may contain different product information. Location information may be located on a binding of the booklet, on the label, or on both the binding and the label. The store labels may be printed in a predetermined order.

1 Claim, 19 Drawing Sheets

Related U.S. Application Data which is a continuation-in-part of application No. 16/104,200, filed on Aug. 17, 2018, now Pat. No. 10,543,709.

(60) Provisional application No. 62/648,695, filed on Mar. 27, 2018.

(52) U.S. Cl.
CPC ..... *G09F 2003/023* (2013.01); *G09F 2003/0226* (2013.01); *G09F 2003/0263* (2013.01); *G09F 2003/0269* (2013.01)

(58) Field of Classification Search
CPC ..... G09F 2003/0222; G09F 2003/0252; G09F 2003/0263
USPC ..... 428/42.3
See application file for complete search history.

(56) References Cited

U.S. PATENT DOCUMENTS

| | | | | | |
|---|---|---|---|---|---|
| 5,782,494 | A * | 7/1998 | Crandall | B42D 5/003 | 281/2 |
| 5,914,165 | A * | 6/1999 | Freedman | B32B 27/32 | 428/40.1 |
| 5,948,494 | A | 9/1999 | Levin | | |
| 6,096,397 | A * | 8/2000 | Murphy | G09F 3/204 | 283/100 |
| 6,116,650 | A | 9/2000 | Nijboer et al. | | |
| 6,981,343 | B2 | 1/2006 | Rawlings et al. | | |
| 7,055,862 | B2 * | 6/2006 | Viby | G09F 3/0288 | 281/31 |
| 9,199,427 | B2 | 12/2015 | Weidauer et al. | | |
| 9,213,506 | B2 | 12/2015 | Nunez | | |
| 9,259,891 | B2 | 2/2016 | Weidauer et al. | | |
| 9,376,286 | B1 | 6/2016 | Browning et al. | | |
| 9,399,331 | B2 | 7/2016 | Weidauer et al. | | |
| 9,434,125 | B2 | 9/2016 | Blackwell et al. | | |
| 9,440,409 | B2 | 9/2016 | Blackwell et al. | | |
| 9,533,464 | B2 | 1/2017 | Weidauer et al. | | |
| 9,547,464 | B2 | 1/2017 | Nunez | | |
| 9,607,531 | B2 | 3/2017 | Weidauer et al. | | |
| 9,802,769 | B1 | 10/2017 | Browning et al. | | |
| 2006/0068145 | A1 * | 3/2006 | Chandaria | B42D 5/003 | 428/40.1 |
| 2013/0320660 | A1 * | 12/2013 | Sato | B42C 3/00 | 283/56 |
| 2015/0202907 | A1 | 7/2015 | Dale et al. | | |

FOREIGN PATENT DOCUMENTS

| | | | | |
|---|---|---|---|---|
| FR | 1445376 | A | 7/1966 | |
| FR | 2956062 | A3 | 8/2011 | |
| JP | 2013011807 | A * | 1/2013 | B42D 5/027 |

OTHER PUBLICATIONS

Vestcom.com, "page from website", "stackz price changes are as quick as pick, peel and stick", , Publisher: http://vestcom.com/stackz/.

* cited by examiner

LABEL BOOK CONTAINING PRINTED STORE LABELS FOR USE ALONG A RETAIL SHELF EDGE

CROSS-REFERENCE TO CO-PENDING APPLICATION

The present application is a continuation-in-part of, and claims priority to, U.S. patent application Ser. No. 16/752,876, filed Jan. 27, 2020, which was a continuation-in-part of U.S. patent application Ser. No. 16/104,200 filed Aug. 17, 2018, issued as U.S. Pat. No. 10,543,709 on Jan. 28, 2020; which, in turn claimed priority to U.S. Provisional Application No. 62/648,695, filed Mar. 27, 2018, all of which are incorporated herein by reference.

BACKGROUND

This disclosure is in the field of printed store labels like those used along a retail shelf edge.

Prior art embodiments include store labels or shelf tags (also called talkers) that arrive at the store as a perforated sheet. The labels, which may or may not be in planogram order, must first be removed as a sheet by detaching the perimeter waste strips and then individually removed from the sheet for hanging along the retail shelf edge.

Another prior art embodiment, NEXGEN (Grandville Printing, Grandville, Mich.), arrives at a store location like a box of cards, with the store labels detached from one another, organized in a box and sorted in planogram order. Because the deck of labels has no linear tie or linkage between adjacent labels, the labels may be sorted through to select a specific label in the deck. However, the deck risks losing its predetermined order due to searching, shuffling, or accidental dropping.

One other prior art embodiment, STACZ (Vestcom, Little Rock, Ark.), arrives at a store location like a stack of POST-IT notes, with the store labels arranged in planogram order on a board. Once a (vertical) stack of labels is selected and removed from the board, the labels are removed in top-down fashion, with each label peeled off the top of the stack in order. Because the stack has a linear tie between adjacent labels, if a label other than the top label is desired the stack must be broken into two parts and joined back together once the desired label is removed. Additionally, the label requires a release coating on its face and an adhesive on its back.

SUMMARY

Embodiments of a store label book of this disclosure may include a binding connecting two or more sheets containing printed store labels, each sheet removable from the binding. The labels may be of a kind configured for use along a retail shelf edge and may differ between the sheets. Each sheet may include a single row of labels or multiple rows of labels. Each row may contain a single label or multiple labels. Adjacent labels may be connected by a perforation. The labels may be printed in a predetermined order.

In some embodiments, the sheet contains two or more booklets of labels that may be detachable from one another. At least one label of each sheet may be removable connected to a binding. The booklet may contain N sheets, with each sheet containing a row or planar array of M labels, where N>1 and $M=(A_R/A_{L\ AVG})$, where $A_R$ is the total area of the row, $A_{L\ AVG}$ is the average area of each label of the row, $(A_R/A_{L\ AVG})$ is rounded down to the nearest integer value ≥1, N and M being integer values. Because the booklet is connected to the binding, the booklet may be searched and a desired label or sheet removed without affecting any other sheet's connection to the binding.

The label may include a printed stock side, a liner including a removable portion, and an adhesive located between the liner and the printed stock side. In other embodiments, the label includes a printed stock side having no liner or adhesive. In yet other embodiments, the label includes a printed stock side and an adhesive on the side opposite the printed stock side. The printed stock side of each store label may differ in size or style and may contain different product information and each sheet of the booklet may be arranged in a same or different predetermined order. Location information may be located on the binding, on the label, or on both the binding and the label. In embodiments, there is no perimeter waste strip.

Other embodiments of a store label booklet of this disclosure may include a binding that runs the entire length of a side of the booklet. The binding may also run less than the entire length. The binding may include a location identifier. Two or more sheets are connected to the binding, each of the sheets including at least one planar array of store labels (which may be arranged in a predetermined order). At least one store label of the planar array may be removably connected along one edge to the binding and adjacent store labels of the planar array may be removably connected to one another along a shared edge. The connection may be a perforation.

Each store label of the planar array may include a printed stock side. The printed stock side of at least one store label of the planar array may contain different product information than at least one other store label of the planar array.

Advantages of a label book of this disclosure over the prior art include but are not limited to labels that arrive at an end user ready for use; labels that may be removably connected to one another by perforations; sheets that are not limited to a single label per sheet or a single booklet per sheet; a binding that remains connected to all of the sheets and may include location identification information; an ability to sort through sheets or labels while the sheets remain connected to the binding and remove a select sheet or label without having to disassemble and reassemble the book or risk re-ordering the sheets or labels; labels that may differ in size, style, and orientation from one another; eliminating the need for card-style box or a board to hold stacks of labels; eliminating a release coating on the printed stock side; accommodating labels that have no adhesive (as well as those that include adhesive); and no perimeter waste strip.

In some embodiments of a label booklet of this disclosure, the booklet includes a tear starter slit that allows a user to tear a stack of labels from the binding or from an adjacent label. The tear starter slit may be a thru-cut, non-perforated portion between the label and the binding and between adjacent labels and located adjacent to, above or below (or both above and below), the perforated portion.

Other embodiments may include a reference identifier label where one or more of the labels of the first sheet of the booklet is replaced by identifying store information. The store information may include category and sub-category information that specifically identifies a location or sub-location within the store where the labels are to be used.

In embodiments, the book may include a plurality of label booklets and configured to transition between a first assembled state consisting of the book, a second different assembled state consisting of label booklets detached from the book, a third different assembled state consisting of a stack of labels detached from the booklet, and a fourth different assembled state consisting of the binding, all of the labels from the booklet being removed.

In other embodiments, the label booklet may be configured to leave a liner strip connected to the binding as a label is removed or as an entire row of labels is removed from the booklet. The liner includes a backside cut running perpendicular to the shared edge to define a liner strip located toward another edge of the store label, the backside cut having a depth no greater than that of the liner. The printed stock side includes a frontside cut running along the shared edge, the frontside cut having a depth no greater than that of the printed stock side and a height no greater than that of the liner strip. On the portion of the label below (or not including) the liner strip, a perforated cut is made through both the printed stock side and the liner, the perforated cut running along the shared edge to the frontside cut.

The back- and frontside cuts are configured to expose an adhesive at a top or bottom of the label when the label is removed along the perforated cut from the booklet. When a user removes a label by pulling from its bottom edge up along the perforation toward the top of the label, the label is released from the liner at the back slit to expose the adhesive. The portion of the liner that remains connected to the binder forms the liner strip. A user may also remove an entire row of labels by pulling from the bottom up along the perforation nearest the binder to remove the entire row of labels at once. Again, the liner strip remains connected to the binder. The liner strip may be left in place as labels of the next sheet are removed from the booklet or it may be detached from the binder and discarded.

ELEMENTS AND NUMBERING USED IN THE DRAWINGS AND DETAILED DESCRIPTION

Figure 1:
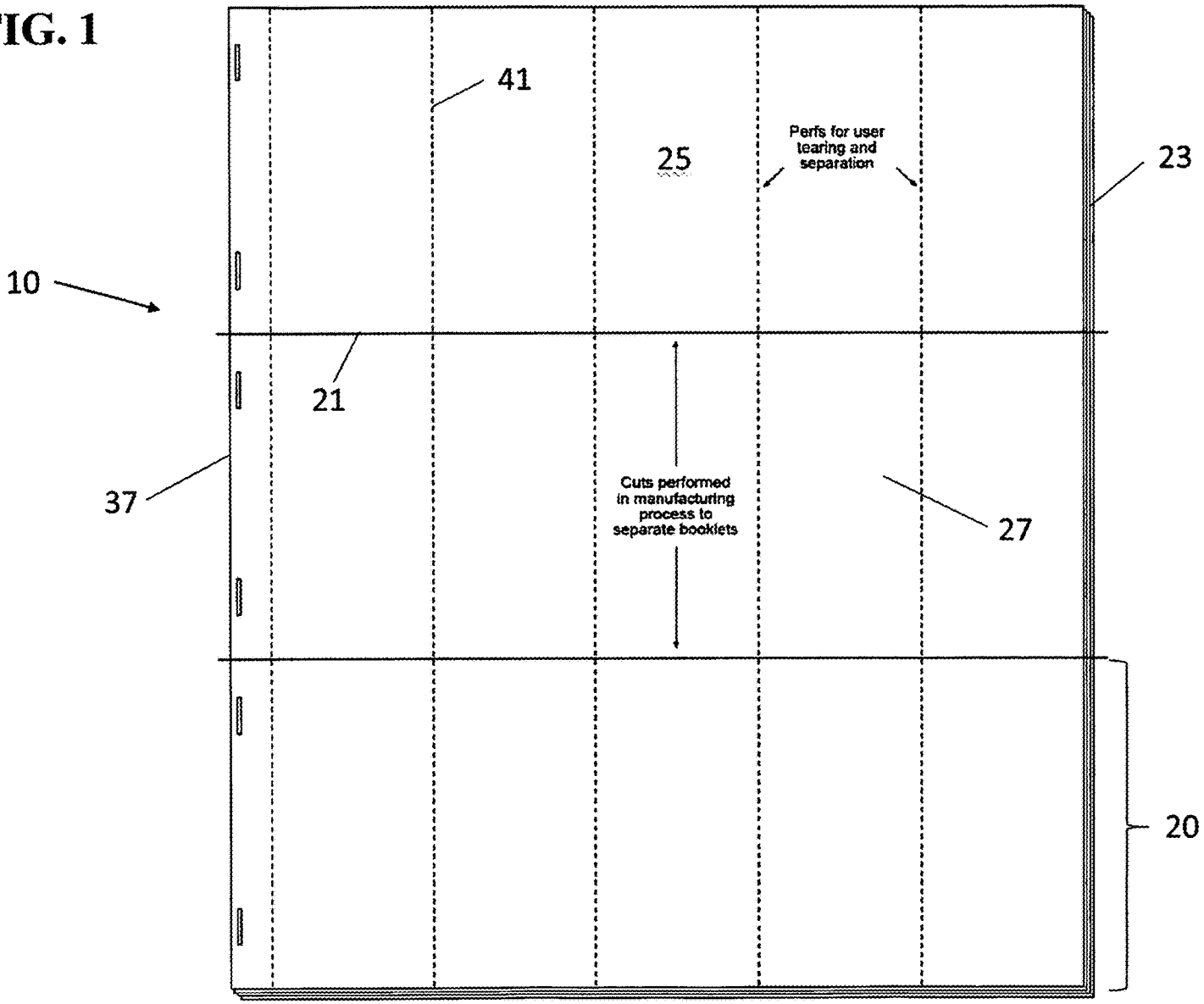
FIG. 1 is an embodiment of an assembled label book of this disclosure during manufacturing. The assembled label book includes a plurality of label booklets and may be cut during manufacturing to separate the booklets. Each detachable label booklet includes a plurality of bound pages or sheets with store labels. The store labels may be printed in a predetermined order on each page.

10 Assembled label book containing one or more label booklets
20 Label booklet
21 Shared edge
23 Plurality of sheets
25 Planar array
27 Shelf tags, store labels, or talkers
29 Printed stock side
31 Removable portion
33 Liner side
33*c* Liner side remaining connected to removed label
35 Adhesive
35*e* Exposed adhesive
37 Binding
38 End
39 Location identifier
41 Edge
42 End portion of edge
43 Corner
44 Middle or mid-portion of edge
45 Front side
47 Back side
48 Perforated portion of shared edge
48*b* End
49 Fixed information (common to all labels)
51 Variable information
53 Adhesive strip
55 Back side
57 Tear starter slit or cut (non-perforated portion of shared edge)
59 Reference identifier
60 Stack of labels
61 Liner strip
61*c* Covered portion of liner strip
61*e* Exposed portion of liner strip
63 Slit
65 Frontside cut through printed stock side only (not extending into the liner side)
67 Backside cut through liner side only (not extending into the printed stock side)
69 End portion

DETAILED DESCRIPTION

Referring the drawing figures, embodiments of this disclosure include an assembled label book 10 that may contain one or more label booklets 20. The label booklets 20 may be detachable that are detachable from one another along a shared edge 21, such as but not limited to a perforated edge, or may be separated by cutting. Each label booklet 20 includes plurality of sheets 23 that each contain a planar array 25 of shelf tags or store labels 27 printed in a predetermined order and detachable from one another. The planar array 25 may be a row or column of a sheet 23. The booklet 20 may contain N sheets, with each sheet containing a row or planar array of M labels, where N>1 and $M=(A_R/A_{L\ AVG})$, where $A_R$ is the total area of the row, $A_{L\ AVG}$ is the average area of each label of the row, $(A_R/A_{L\ AVG})$ is rounded down to the nearest integer value ≥1, N and M being integer values. The row may be arranged horizontally with the binding along the side of the N sheets or vertically with the binding along the top or bottom of the N sheets.

In embodiments, the printed stock side 29 of the labels 27 does not include a release coating. A removeable portion 31 of the liner side 33 exposes adhesive 35 for attaching the label 27 to a store shelf edge E. Because the label booklets 20 are arranged in a predetermined order in addition to providing location information and ease of detachment, significant labor savings may be realized by a user.

The booklet 20 includes a binding 37 to which the sheets 23 of the booklet 20 are removably connected. For the purposes of this disclosure, a binding is a shared connector that spans a total thickness of the booklet and allows any sheet of the booklet to be removed from the binding without breaking the binding's connection to the other sheets. Prior art embodiments like NEXGEN do not include any binding and others, like STACZ, do not make use of a binding as it is defined here.

In embodiments, the label booklet 20 includes a binding 37 that may include a location identifier 39 and one or more sheets 23 removably connected along an edge 41 to the binding 37. A sheet 23 may be removed from the binding 37 without affecting other sheets 23 of the booklet, which remain connected to the binding 37. The same is true when a label 27 is removed from the sheet 23: the sheet 23 and its remaining labels 27 remain connected to the binding 37. Therefore, the booklet 20 does not require re-assembly when sheet 23 N>1 is removed from the binding 37, where N=1 is the topmost sheet remaining connected to the binding 37 or when a label 27 is removed from an N>1 sheet 23.

The sheets 23 may be connected to the binding 37 along a top or bottom edge, or a side edge 41T, 41B, 41S. In some embodiments, the binding 37 may be located at a corner 43.

The binding 37 may also be located at one or more points along an edge 41. The binding 37 may be any binding suitable. For example, the binding 37 may include a paper stock or a plastic binding. In some embodiments, the binding 37 may include an adhesive or one or more mechanical fasteners such as but not limited to a staple or a rivet. The binding 37 may be a book-type (glue) binding or a notepad-type binding where labels 27 "peel off" from the binding 37. The sheets 23 containing the one or more labels 27 are connected to a binding 37.

The location identifier 39 may be a store identifier, a department identifier, an aisle identifier, a category identifier, a planogram identifier, a program identifier, or some combination of these identifiers or their equivalent. The location identifier 39 may be printed on a front 45 or back 47 side of the binding. In some embodiments, one location identifier 39 is printed on the front side 45 of the binding 37 and another location identifier 39 is printed on the back side 47. The front and back side location identifiers 39 may include the same identifiers or different identifiers.

Each sheet 23 may be configured as a planar array 25 of store labels 27 arranged in a predetermined order. Adjacent store labels 27 of the planar array 25 may be removably connected to one another along a shared edge 21. The assembled label book 10 may be delivered to an end user for disassembly by the end user into the one or more label booklets 20. Alternatively, the assembled label book 10 may be disassembled at the printer and the one or more label booklets 20 delivered to the end user for immediate use. For example, the label book 10 may be cut to produce two or more label booklets 20. Because the sheets 23 are connected to the binding 37, perimeter waste strips are eliminated (either full perimeter or left/right or top/bottom). The only waste is the binding 37 when the booklet 20 is emptied of sheets 23.

The label booklet 20 may include additional sheets 23 configured as a planar array 25 of store labels 27 removably connected to the binding 37 and located directly below, and identical to, the planar array 25 located above it. In some embodiments, an orientation of one store label 27 of the planar array 25 may be different than an orientation of at least one other store label 27 of the planar array 25.

The store label 27 may include a printed stock side 29 on which fixed 49 and variable 51 product information may be printed; a liner 33 located opposite the printed stock side 29 that includes a removable portion 31 located toward an edge 41 of the store label 27; and an adhesive 35 located between the liner 33 and the printed stock side 29. The removeable portion 31 of the liner 33 may be located toward a top edge, a bottom edge, or a side edge 41T, 41B, 41S of the store label 27. The adhesive 35 may be of a kind well known in the art and used to adhere store labels to a retail shelf edge.

In embodiments, the sheet 23 may include identifying information on a back side 47 of the sheet 23. By way of a non-limiting example, a location identifier 39 the same or similar to that discussed earlier may be included on the back 47 of each store label 27. For example, in some embodiments the location identifier 39 may be a number, a planogram spot, or a department (or some combination thereof). This feature can be useful if a store label 27 is detached from the booklet 20 and the binding 37 cannot be referenced or located.

In embodiments, each label 27 may have variable data 49. For example, in some embodiments the variable data 49 may include the stock keeping unit ("SKU"). Adjacent labels 27 may reference a different SKU. Each label 27 may have the same style or image or can have its own style or image independent of the label 27 adjacent to it. Each row or column of labels 27 on the sheet 23 can be (but does now have to be) a similar printed style to labels 27 adjacent to it. For example, labels 27 may transition from SALE, to TEMPORARY PRICE REDUCTION OR TPR, to AS ADVERTISED to NUTRITIONAL or GLUTEN FREE tag all in same row if desired. The labels 27 may be arranged in department sequence, planogram order, or some other order required by an end user.

A shared edge 21 of adjacent store labels 27 may include a perforated edge. The shared edge 21 may be a top, bottom, or side edge 41. The printed stock side 29 of at least one store label 27 of the planar array 25 may contain the same or different product information than that of at least one other store label 27 of the planar array 25. The orientation of each store label 27 may be the same or different than that of another store label 27 of the array 25. In some embodiments, the size of the labels 27 may differ in the array 25.

In embodiments, the booklet 20 may be made of any appropriate media including, but not limited to, paper-based media (e.g. cardstock or its equivalent), a laminated paper-based media, a film or thermoplastic material (e.g. polypropylene or its equivalent), or a fabric material (e.g. polyester). In some embodiments, the booklet 20 does not make use of a liner 33 including a "crack-and-peel" to expose the adhesive 35. The booklet 20 may include the appropriate media without adhesive or a liner and may include an adhesive strip 53, similar to double-sided tape strip or its equivalent, that is applied to the back side 55 of the media.

Embodiments of a booklet of this disclosure are not tied to a specific method of adhesive and liner. For example, embodiments are not limited to a crack-and-peel liner designed to expose the adhesive. In some embodiments the booklet may be cardstock having no adhesive. The adhesive may be an adhesive strip applied to the back with a liner to pull off (e.g., double-sided tape or its equivalent). Additionally, the store labels contained in the booklet may having printed data or information on the back side. For example, a label identifier or planogram location may be printed on the back of the label. Identifying information printed on the front of the label may be limited to that which assists store personnel should the label become detached from the binder.

Referring now to FIGS. 13-18, embodiments of a label booklet 20 of this disclosure may include a thru-cut or tear starter slit 57 located at a top 41T or bottom 41B of the booklet 20, the slit 57 replacing a portion of the perforated portion 48 located along each side 41S of the labels 27. The tear starter slit 57 allows for easier tearing of the perforation for separation of a single label 27 from the booklet 20 or, more importantly, multiple labels 27 at a single time to form stack 60. Tearing a stack 60 of perforated labels 27 without the slit 57 is difficult to do and can damage one or more of the labels 27 when attempting to do it. The number of labels 27, that is sheets 23, that can be cleanly removed is also limited without the slit 57. When provided with the tear starter slit 57, it allows a user a clean and easy separation and start of the perforated tear process. It also allows for a larger number of labels 27, and therefore a larger stack 60, to be removed from the booklet 20 without the needed for excessive hand or grip strength.

In some embodiments, the slit 57 may be in a range of about ⅛" or ¼" to ½" in length. The slit 57 may be about 10%, 15%, 20%, 25%, or in a range of 10% to 25% of the total height (top-to-bottom distance) of the booklet 20, there being subranges and discrete values within this broader range. The slit 57 allows a user to easily tear a stack 60 of labels 27 from the booklet 20, the stack 60 spanning multiple sheets of the plurality of sheets 23. In some cases, the stack 60 may be two or three sheets 23 deep. In other cases, the stack 60 may be a ¼, ½, ¾ of the entire depth or thickness of the booklet 20. In yet other cases, the stack 60 may be the entire depth of the booklet 20. The booklet 20 may be a ½" to 1" deep (tall), there being subranges and discrete values within this broader range.

Other embodiments may include a reference identifier label 59, where one or more of the labels 27 of the first sheet of the plurality of sheets 23 of the booklet 20 is replaced by identifying store or location information for the entire booklet 20. The identifying information may include category and sub-category information for the store that specifically identifies a location or sub-location within the store where the booklet 20 is to be used.

Figure 2:
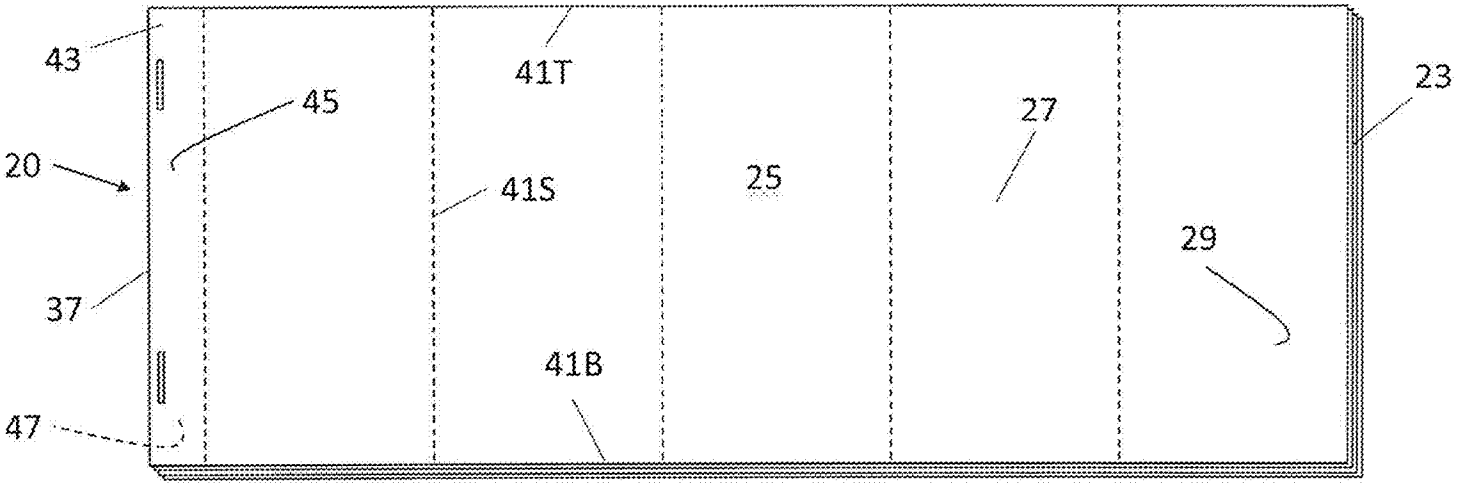
FIG. 2 is an embodiment of a label booklet detached from an assembled label book of FIG. 1. The label booklet may be configured to include only a single label on each page or, as shown in FIG. 2, two or more labels.
Figure 3:
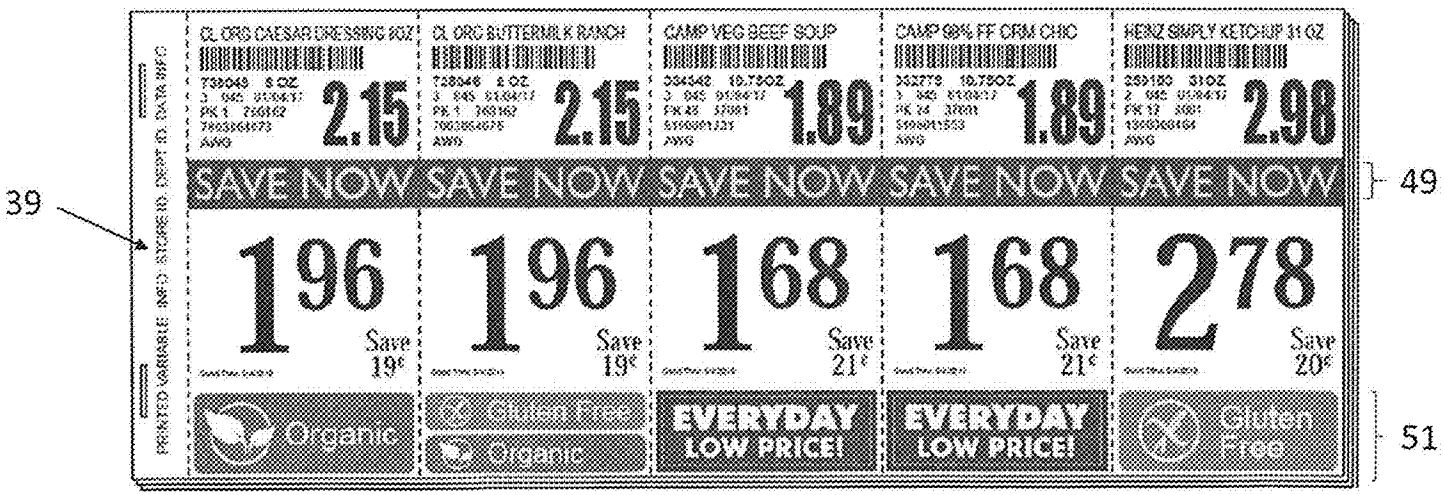
FIG. 3 is an embodiment of a label booklet having a number printed store labels. Each label contains fixed information and variable information such as different product information. Location identifying information may be printed on the binding and may be included on the labels.
Figure 19:
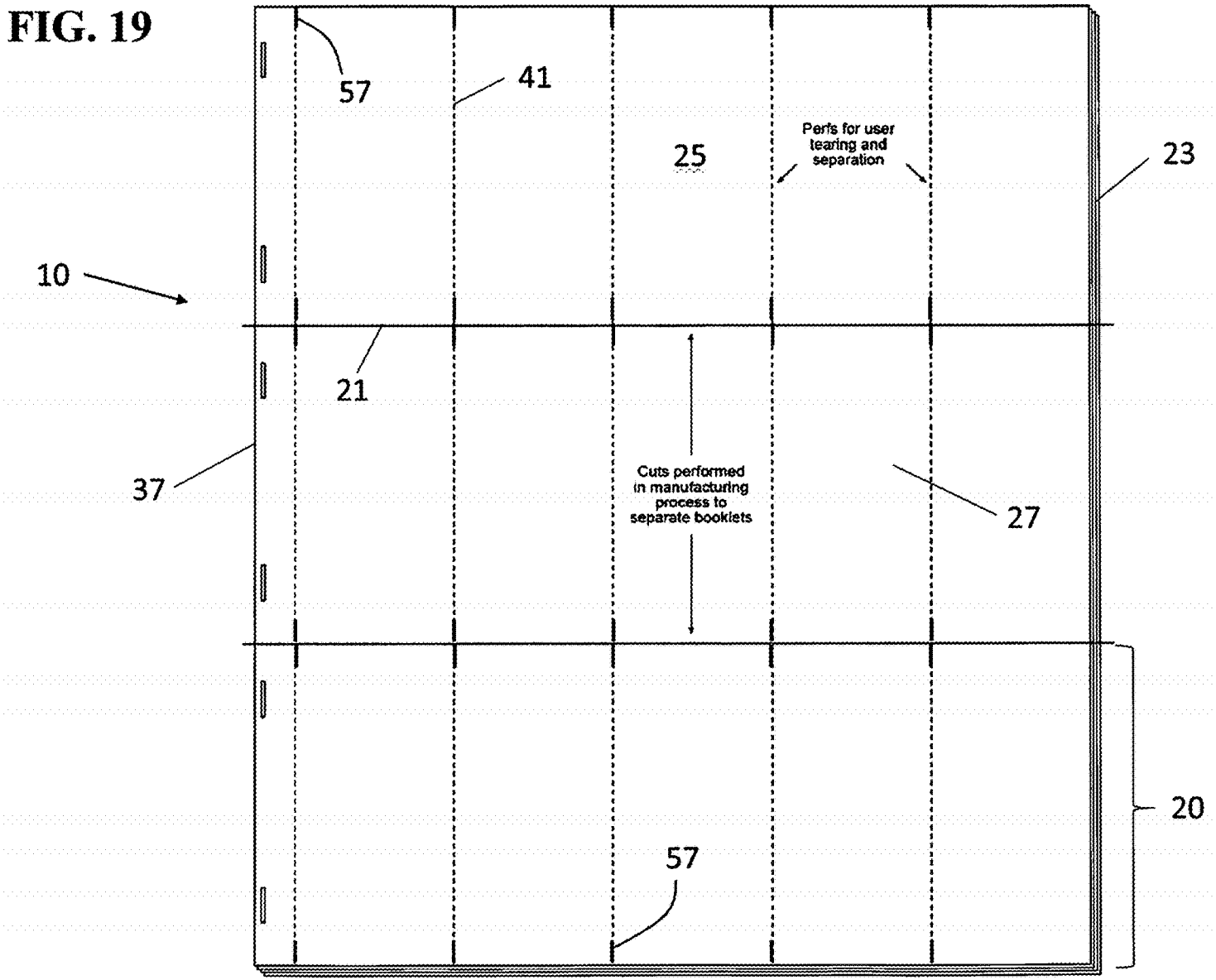
FIG. 19 is an embodiment of label booklets including a tear starter slit in a first assembled state. The label book includes a plurality of label booklets that may be detached from one another to separate the booklets. Each detachable label booklet includes a plurality of bound pages or sheets with store labels. The store labels may be printed in a predetermined order on each page.
Figure 20:
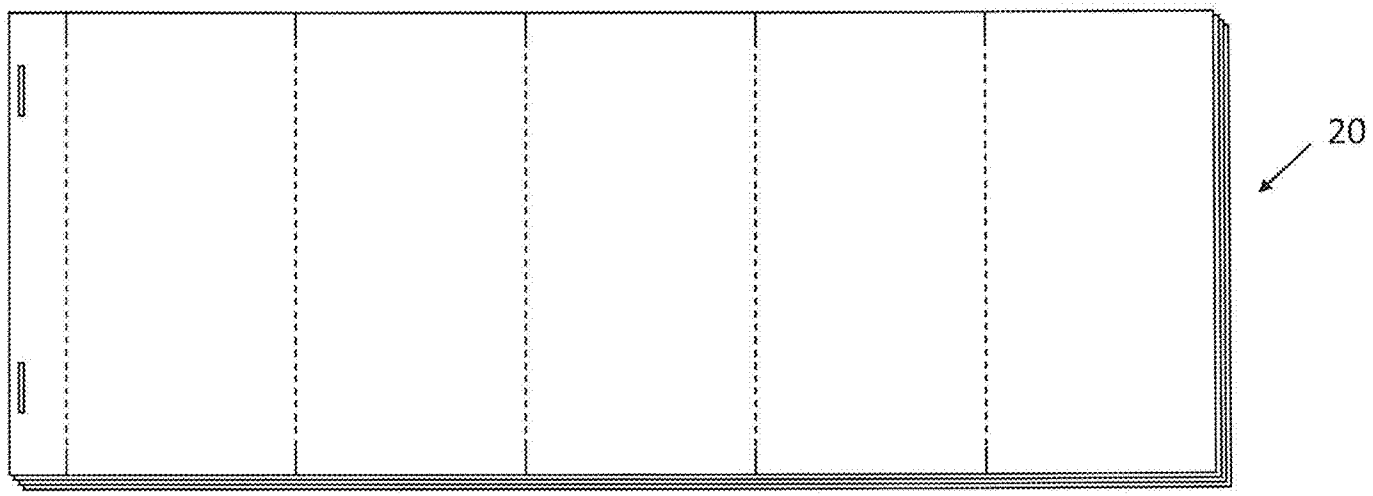
FIG. 20 is a label booklet of FIG. 19 in its second assembled state, detached from adjacent label booklets of the label book.

In embodiments, a plurality of label booklets 20 include booklets 20 that are configured to transition between a first assembled state, see e.g., FIGS. 1 & 19, and a second different assembled state, see e.g., FIGS. 2 & 20. Each label booklet 20 includes a plurality of N sheets 23 removably connected at one end 38 (toward binding 37) of the booklet 20, with each of the N sheets 23 consisting of a planar array 25 of M store labels 27. Each store label 27 of the planar array 25 is removable from an adjacent store label 27 along a shared edge 41S. A middle portion 44 of the shared edge 41S may be perforated and an end portion 42 of the shared edge 41S may be thru-cut, forming a tear starter slit 57. Each sheet 23 is reduced in area as a store label 27 is removed from the planar array 25, there being no perimeter waste remaining connected to the sheet. Each store label 27 of the M store labels of this embodiment includes a printed stock side 29 extending an entire width and length of the store label 27 and containing product information 51 different than other store labels 27 of the planar array 25, a liner 33 located opposite the printed stock side 29 and extending the entire width and length of the store label 27, and an adhesive 35 located between the liner 33 and the printed stock side 29. The liner 33 may include a removable portion 31, 53 located toward an edge 41T or 41B of the store label and a fixed portion 55. The removable portion 31, 53 may be smaller in area than the fixed portion 55.

Figure 4:
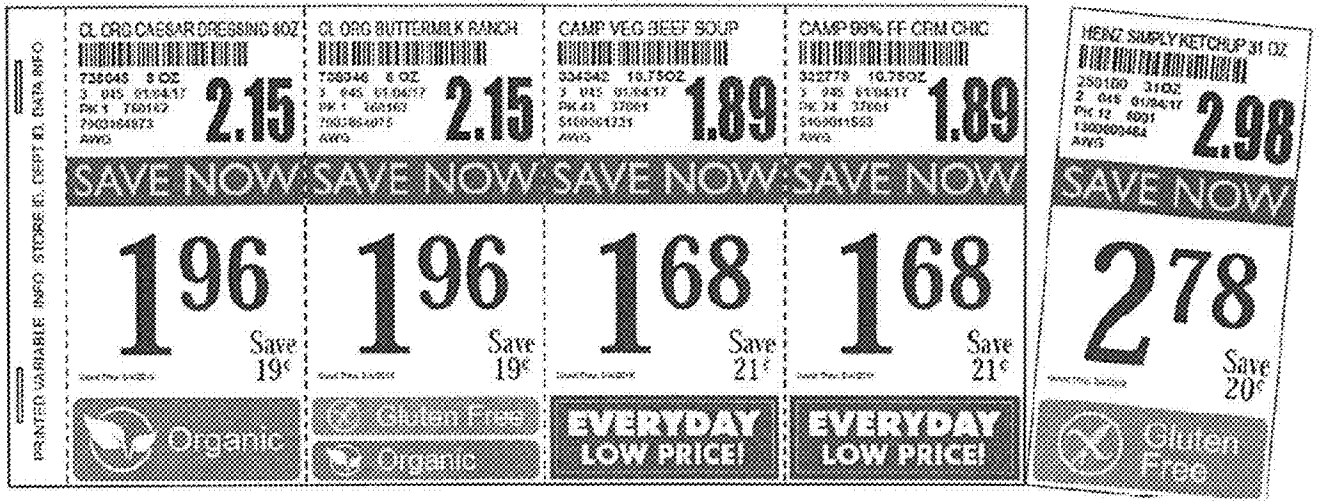
FIG. 4 is a view of a store label being detached from its adjacent store label. In embodiments, adjacent labels are connected by a perforated edge.
Figure 5:
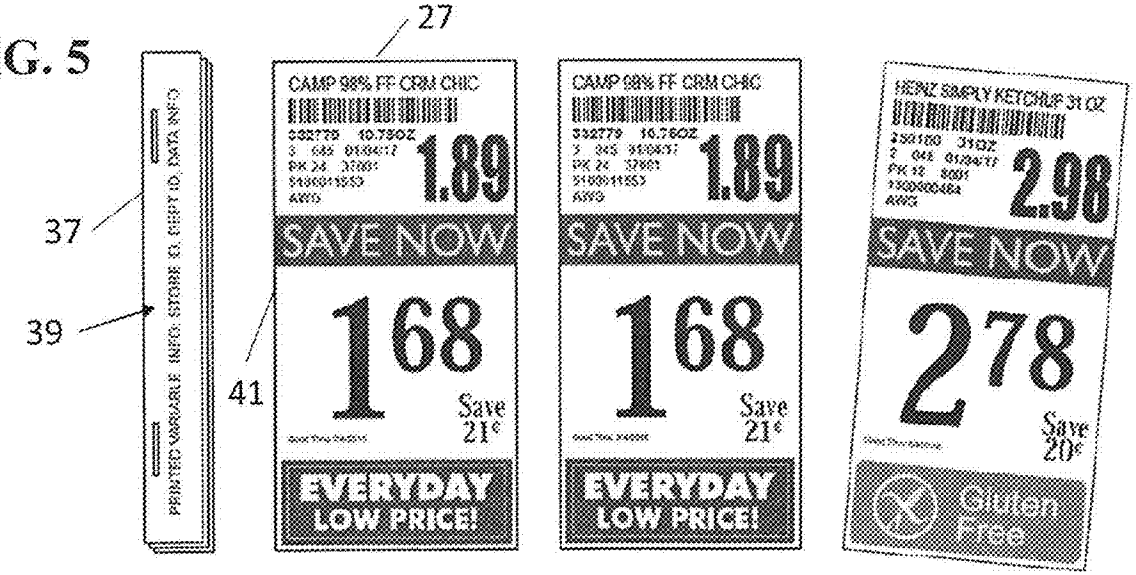
FIG. 5 is the labels of FIG. 4 completely detached (as a last remaining sheet) from the label booklet.
Figure 7:
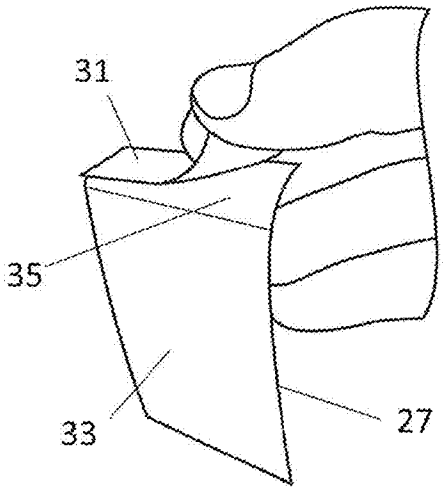
FIG. 7 is a view of the liner side of the label of FIG. 6.
Figure 6:
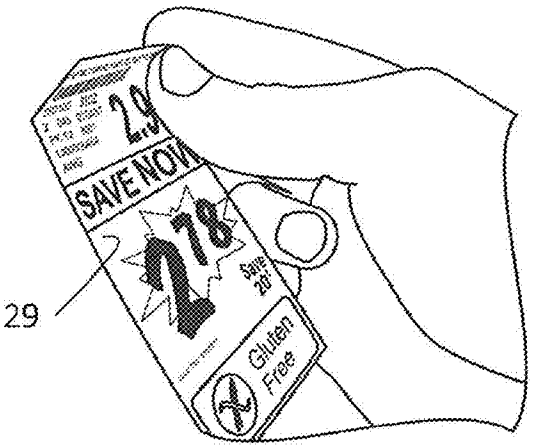
FIG. 6 is an embodiment of a detached store label of this disclosure. The liner includes a removable portion located toward an edge of the label to expose an adhesive. Other embodiments may include no liner or adhesive or may make use of an adhesive strip applied to the back of the label.
Figure 9:
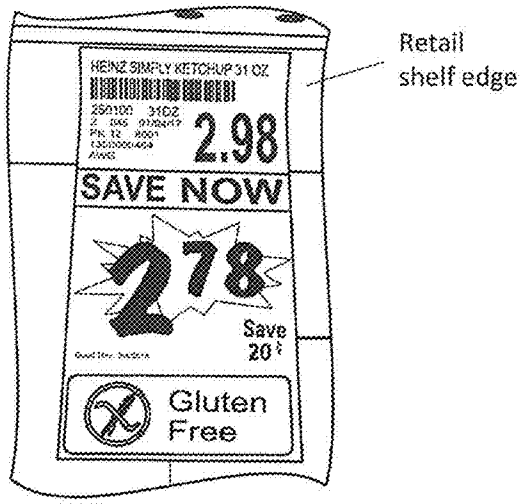
FIG. 9 is a view of the label of FIG. 6 when adhered to the store shelf edge.
Figure 8:
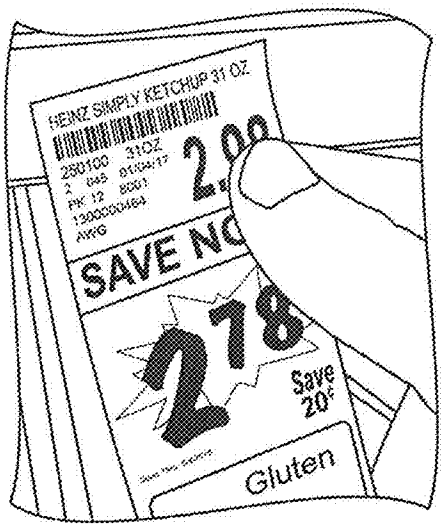
FIG. 8 is a view of the label of FIG. 6 as it is being positioned for application to a store shelf edge.
Figure 10:
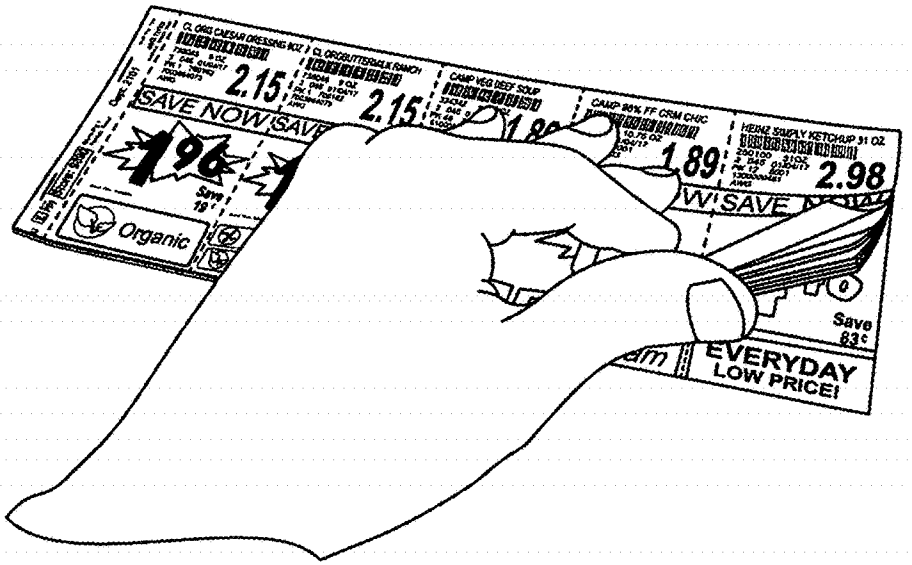
FIG. 10 is an embodiment of a label booklet of this disclosure. Store labels of one sheet of the booklet may be different than those printed on other sheets of the booklet.
Figure 11:
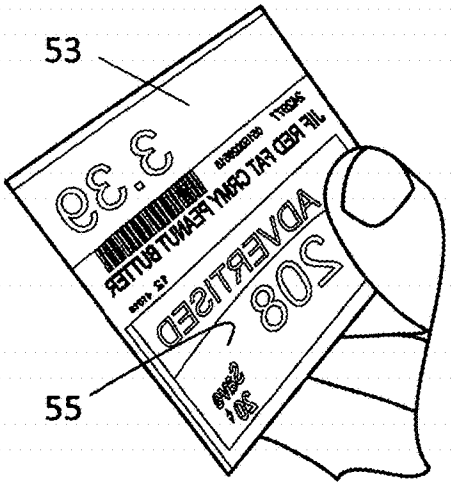
FIG. 11 is an embodiment of a store label made of an appropriate media, such as but not limited to cardstock, and including an adhesive strip that may be added. The label booklet includes a plurality of these store labels.
Figure 12:
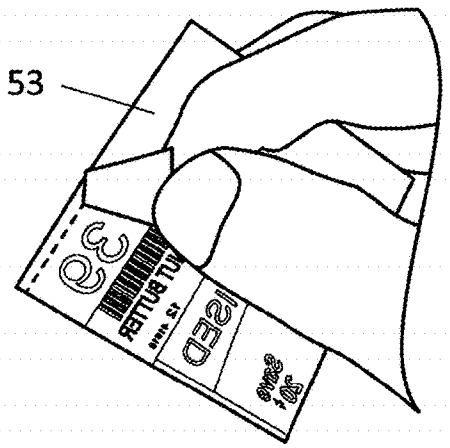
FIG. 12 is view of the store label of FIG. 11 with the adhesive of the strip being exposed.
Figure 13:
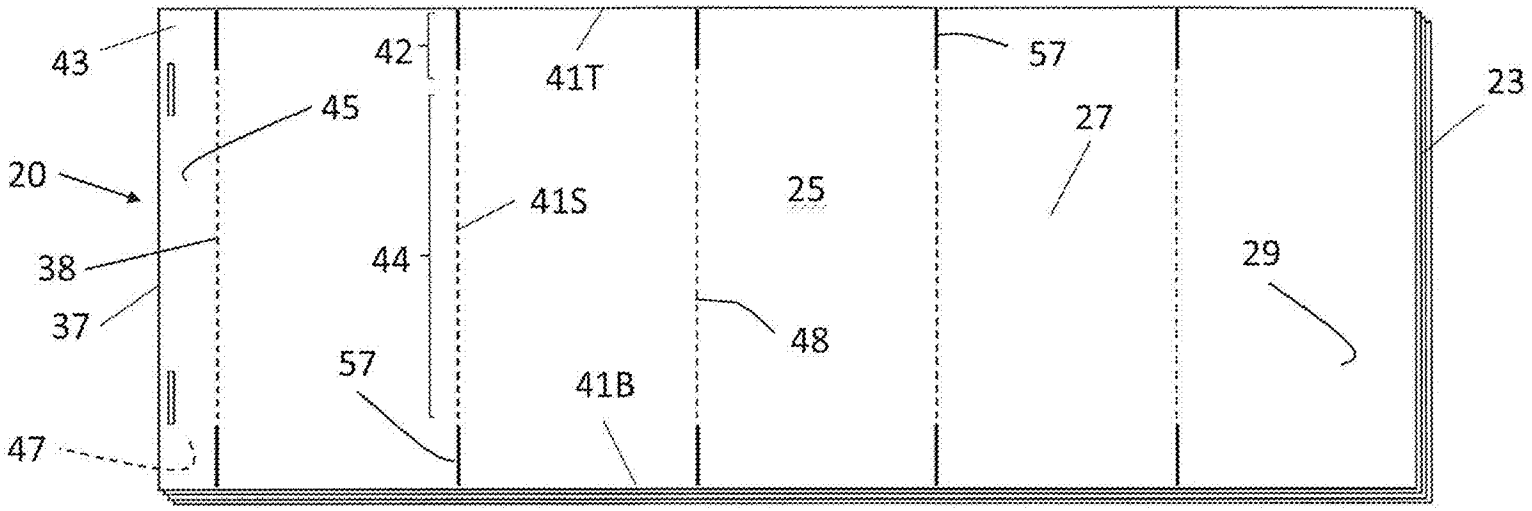
FIG. 13 is an embodiment of a label booklet that includes a tear starter slit at the top and bottom of each label.
Figure 14:
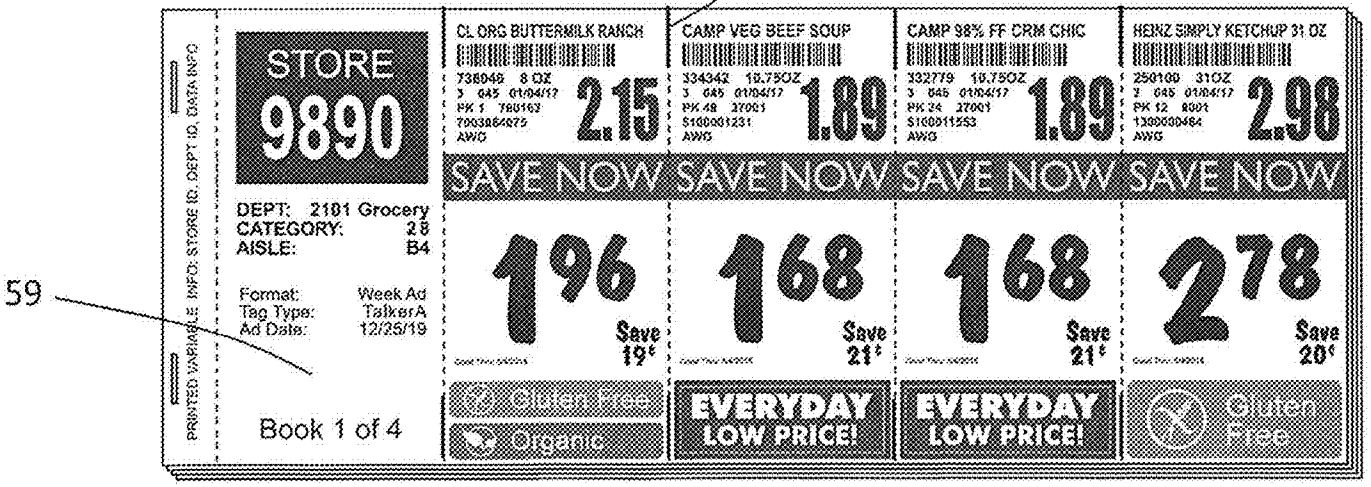
FIG. 14 is an embodiment of a label booklet that includes a reference identifier in place of one of the store labels located on the first sheet of the label booklet.
Figure 15:
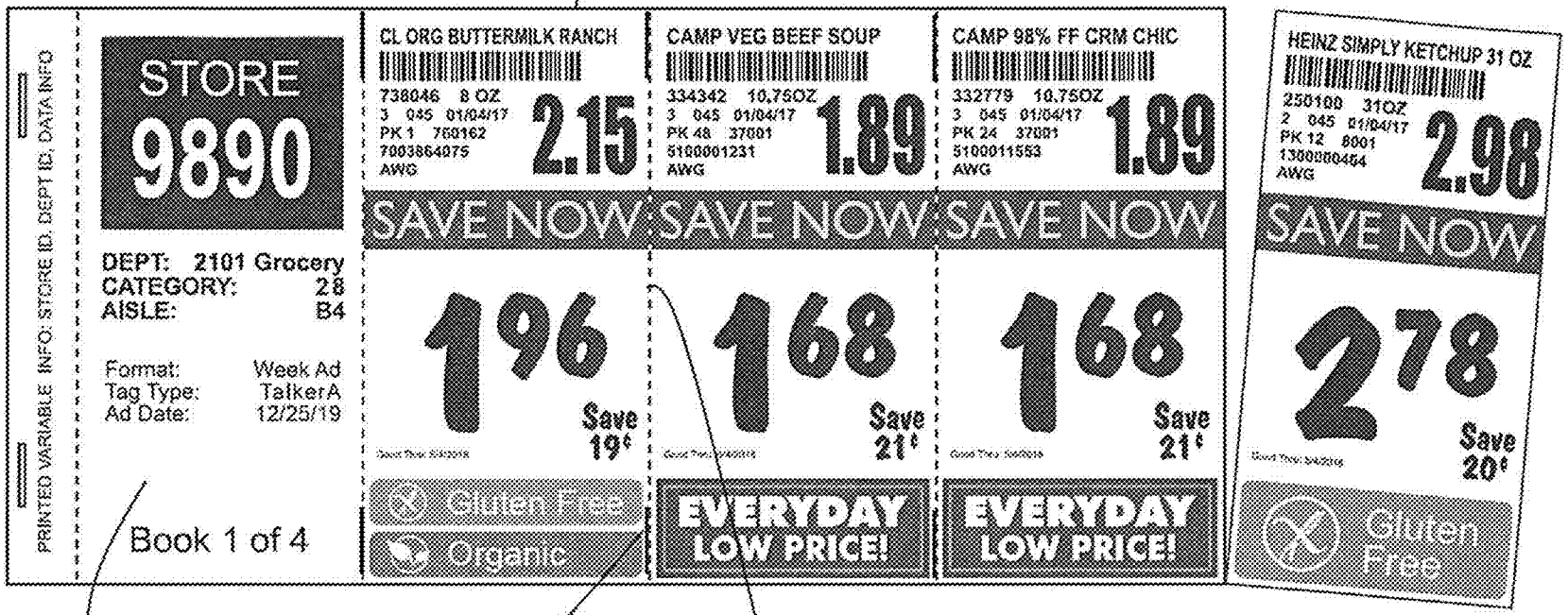
FIG. 15 is the label booklet of FIG. 14 with a first stack of labels being removed from the booklet by way of the tear starter slit or cut.
Figure 17:
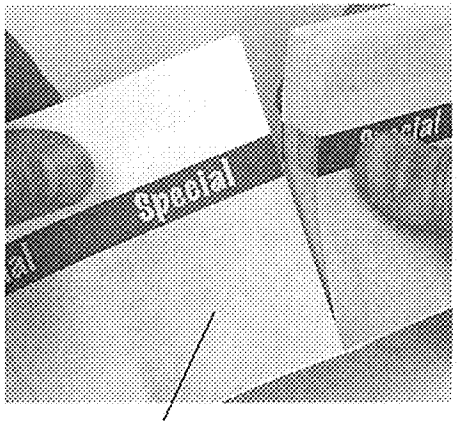
FIG. 17 is a photograph illustrating tearing of a stack of labels from a booklet of this disclosure.
Figure 16:
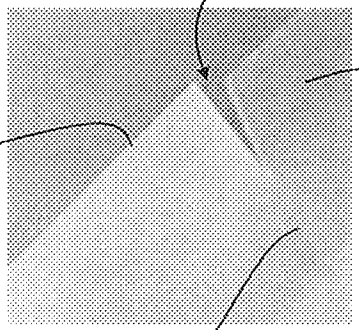
FIG. 16 is a photograph of a portion of the label booklet with the tear starter slit as a stack of labels is being removed from the booklet.
Figure 18:
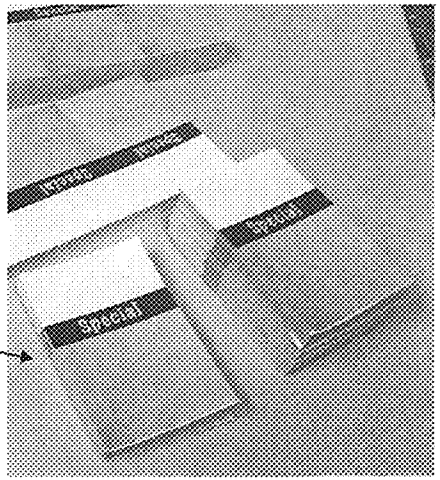
FIG. 18 is a photograph of stacks of labels after their removal from the booklet.
Figure 21:
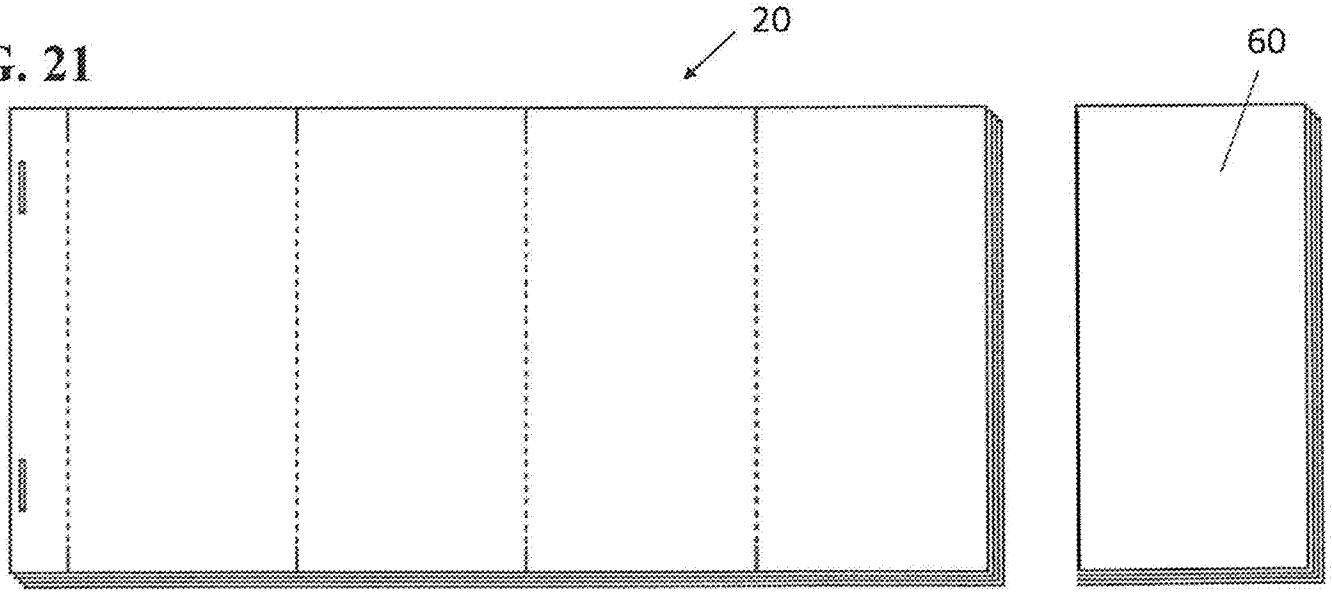
FIG. 21 is the label booklet of FIG. 20 in its third assembled state, a stack of labels being detached from the remaining portion of the booklet.
Figure 22:
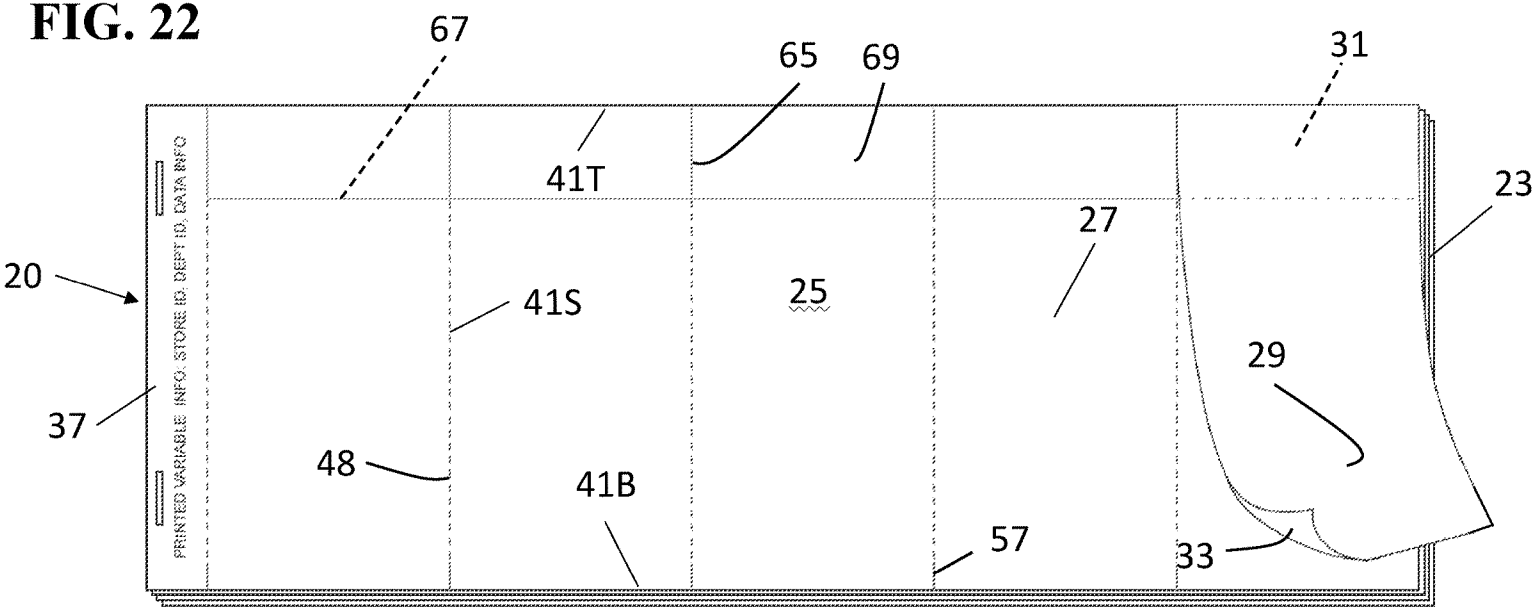
FIG. 22 is an alternate embodiment of a label booklet of this disclosure. A backside cut is included for each label on the liner side, a frontside cut on the printed stock side, and a perforated cut through both the printed stock side and the liner below the liner strip. When a user removes a label by pulling from its bottom up along the perforation, the label is released from the liner at the back slit to expose the adhesive. The top end of the liner stays attached to the booklet. The assembled label book may be arranged like that of FIG. 1 during manufacturing and may be cut during to separate the booklets.
Figure 23:
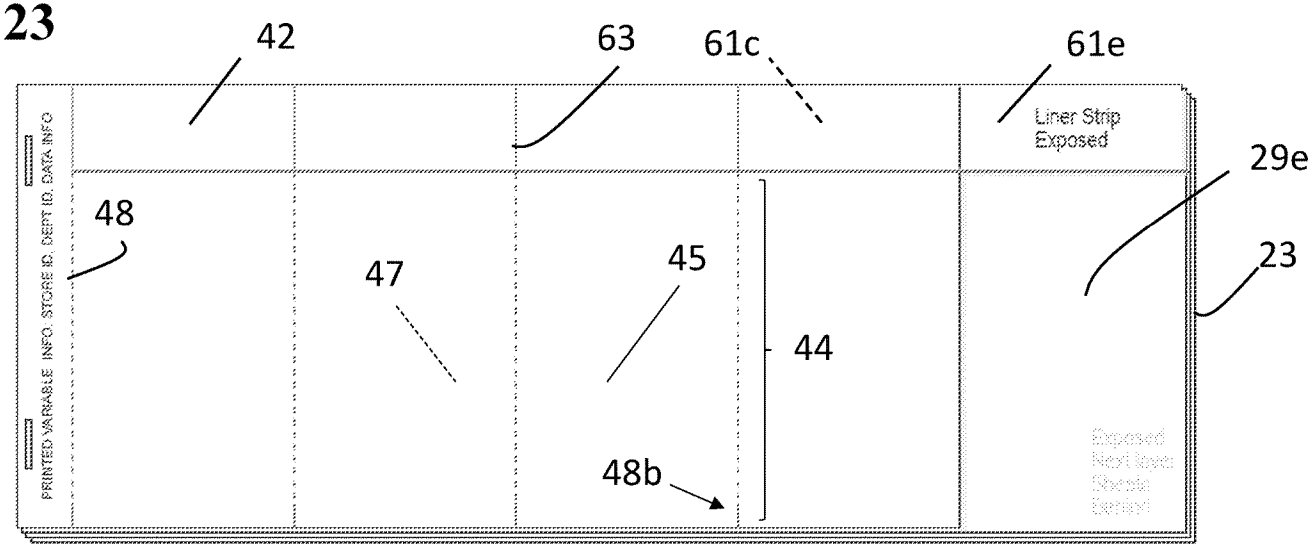
FIG. 23 is the label booklet of FIG. 22 with a label removed from the booklet. A portion of liner strip associated with the removed label is exposed as well as the label of the next sheet, partially hidden by the portion of the liner strip and directly below that of the removed label. A remainder of the liner strip remains hidden, still connected to the other labels of the sheet.
Figure 24:
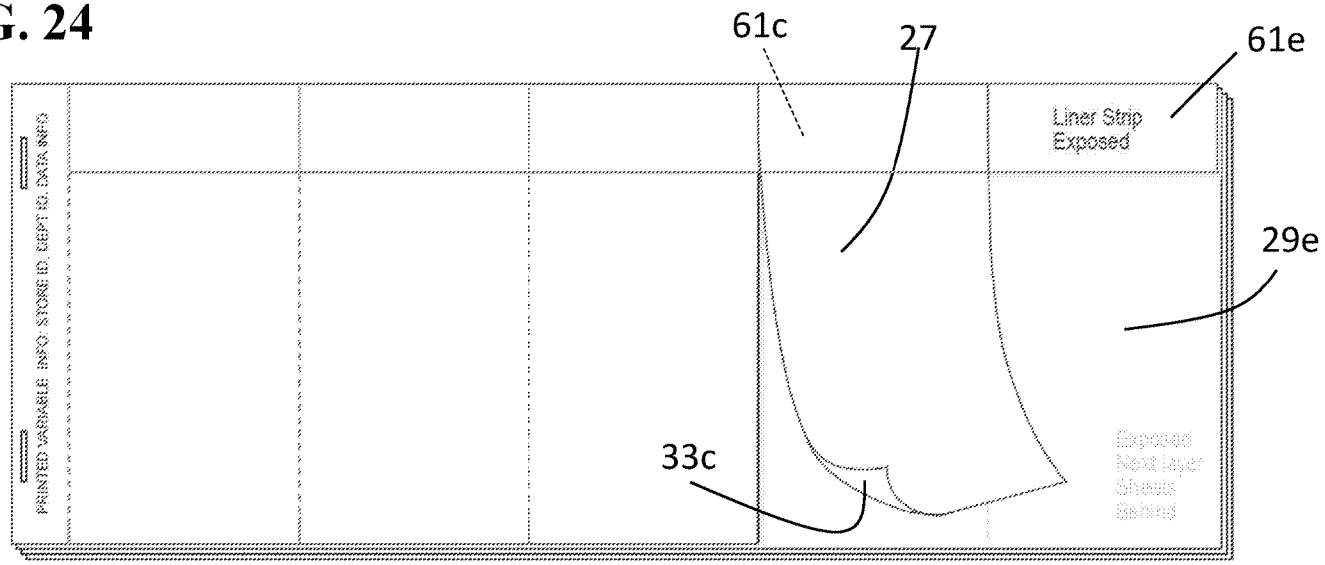
FIG. 24 is the label booklet of FIG. 23 with a second label being removed from the booklet.
Figure 25:
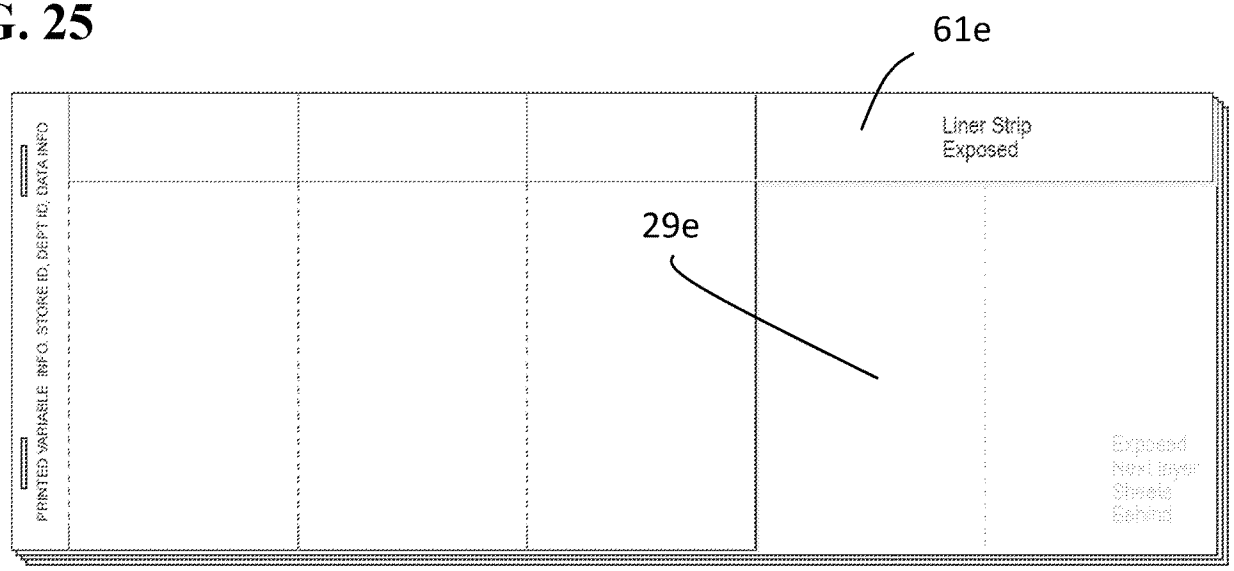
FIG. 25 is the label booklet of FIG. 24 after the second label is removed and a second portion of the liner strip is exposed. Because the liner strip remains connected to the binding, and because the liner strip is shared among the labels of each sheet, as each label is removed from the sheet, more and more of the liner strip becomes exposed.
Figure 26:
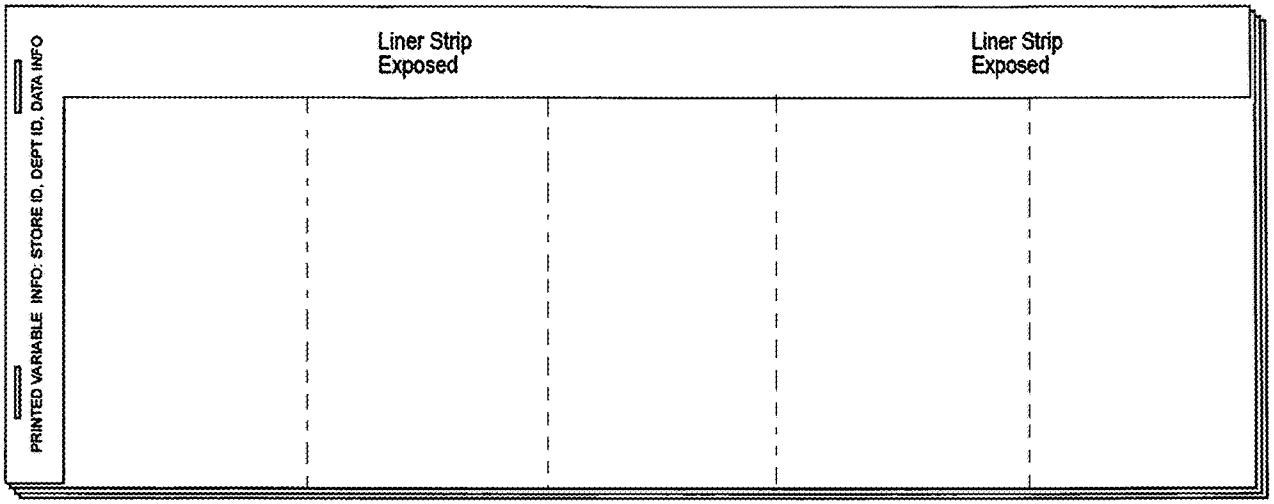
FIG. 26 is the label booklet of FIG. 25 after each label of the sheet has been removed. The entire liner strip of the sheet is exposed as are the labels of the next sheet. The liner strip remains connected to the binding.
Figure 27:
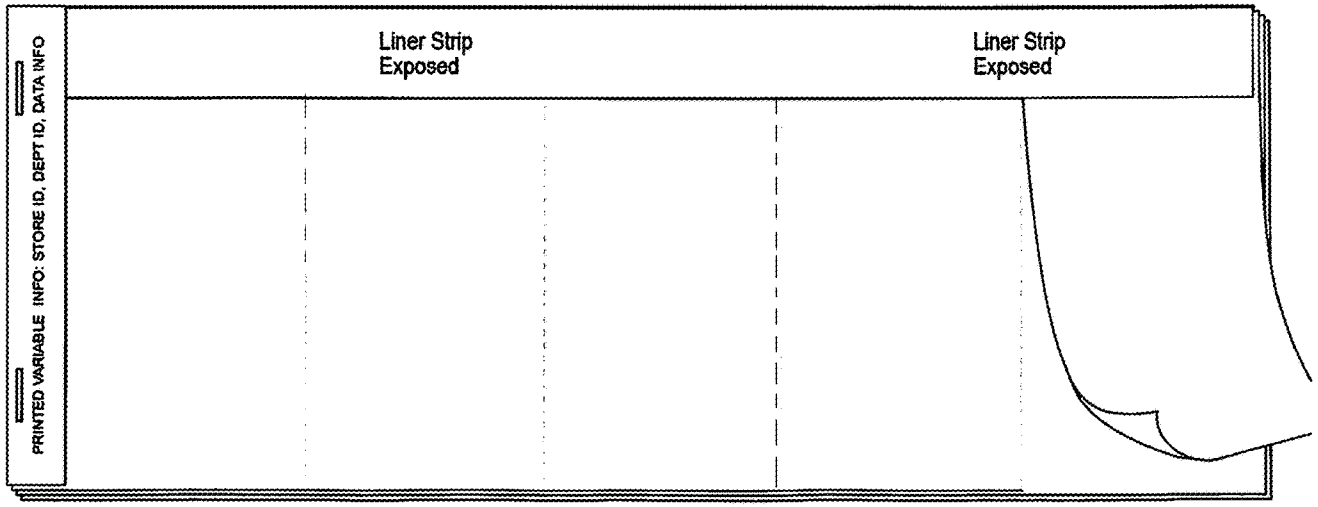
FIG. 27 is the label booklet of FIG. 26 with a label being removed from the next sheet. The liner strip of the previous sheet may overlay the labels of these sheets, as shown here, and may be removed from the binding to expose the entirety of the labels or left connected to it.
Figure 28:
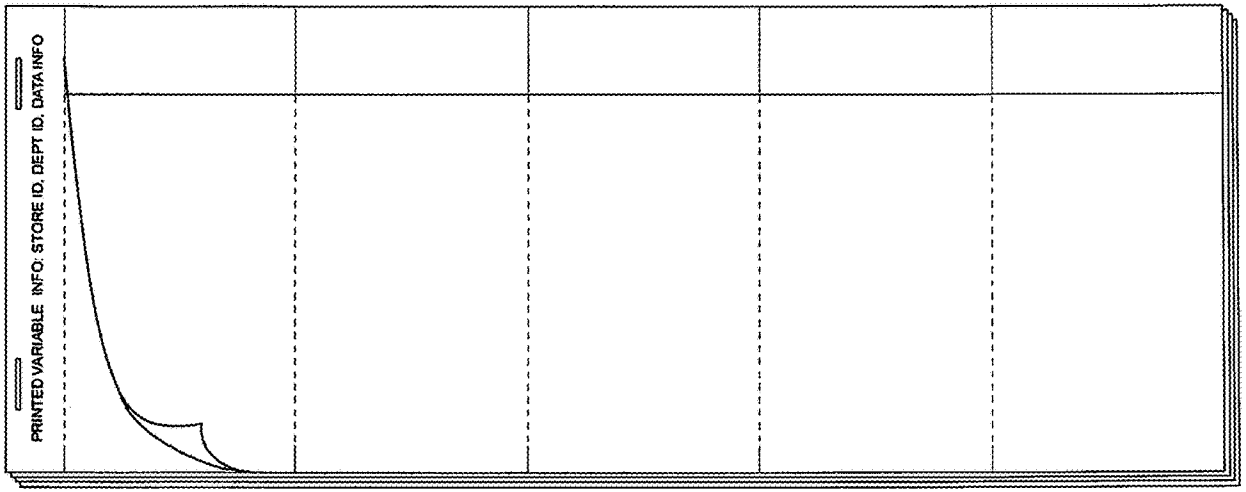
FIG. 28 is another embodiment of a label booklet of this disclosure. An entire row of labels may be removed, with the top adhesive exposed. When the first row of labels is removed, the liner strip remains connected to the binding as shown in FIG. 30 and may be removed or left connected to the binding.
Figure 29:
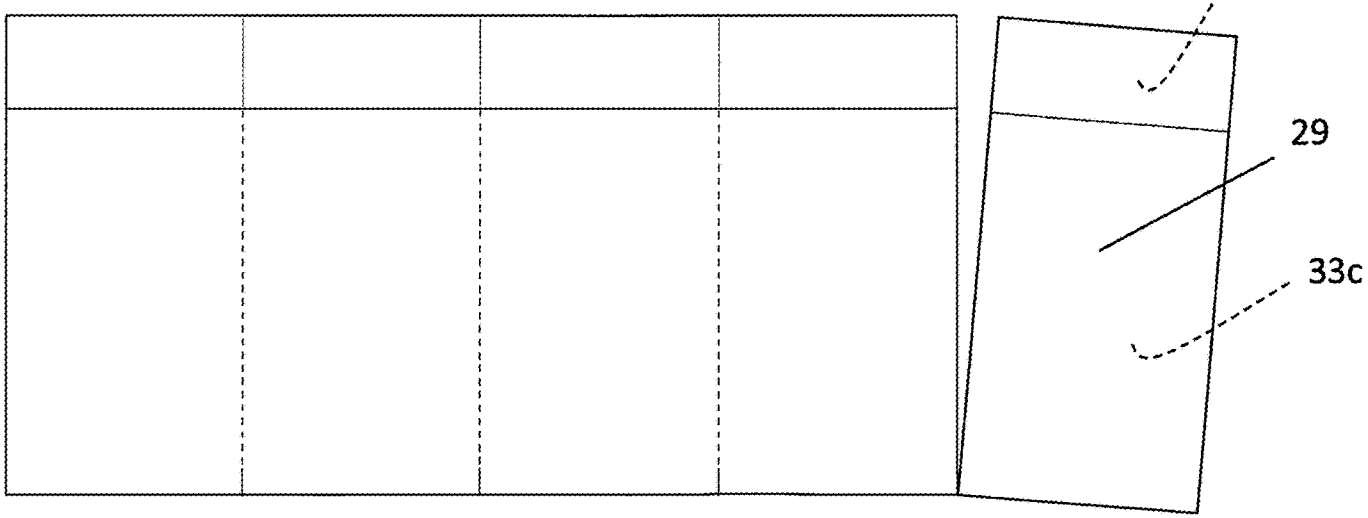
FIG. 29 is the removed row of labels from the booklet of FIG. 28. A user separates a label from the row and adheres the label to the shelf using the exposed top adhesive.
Figure 30:
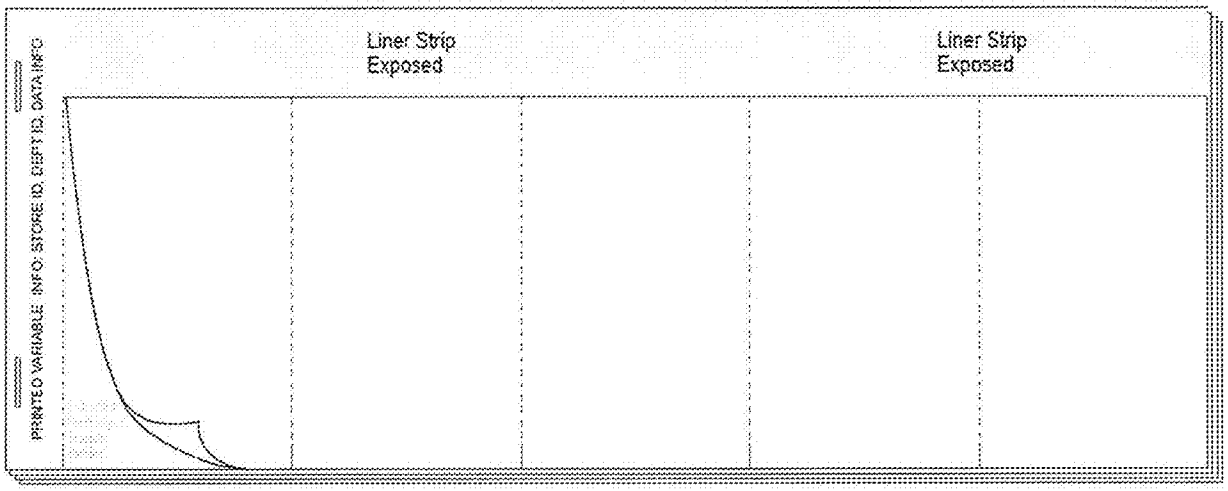
FIG. 30 is the label booklet of FIG. 28 after an entire row of labels has been removed from the booklet and a user begins to remove the next row of labels.
Figure 31:
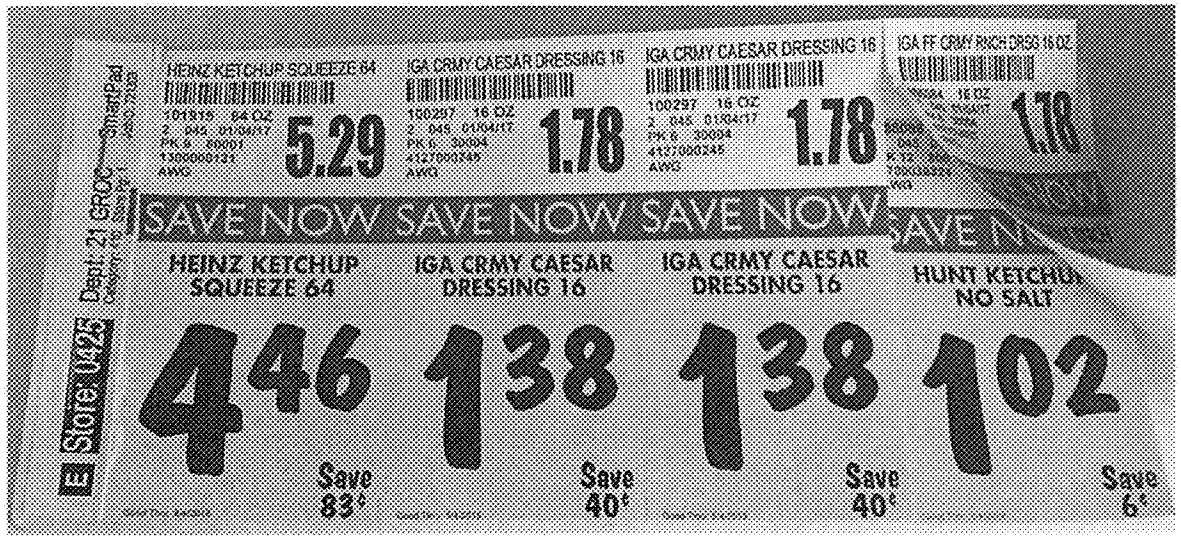
FIG. 31 is an example embodiment of a label booklet of this disclosure in which a liner strip remains connected to the binding.
Figure 32:
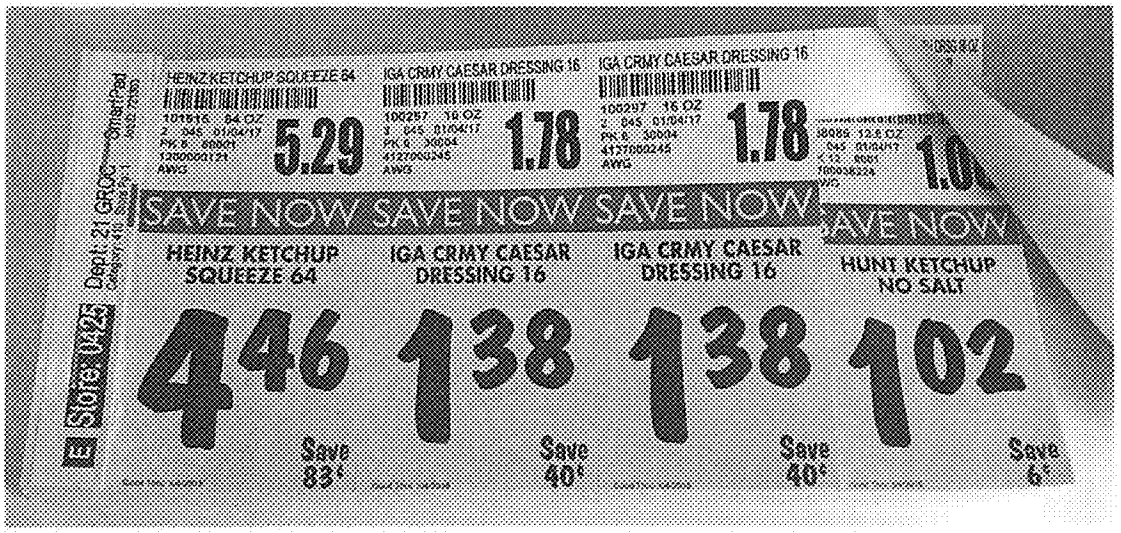
FIG. 32 is the label booklet of FIG. 31 as a first label is being removed, exposing the liner strip.
Figure 33:
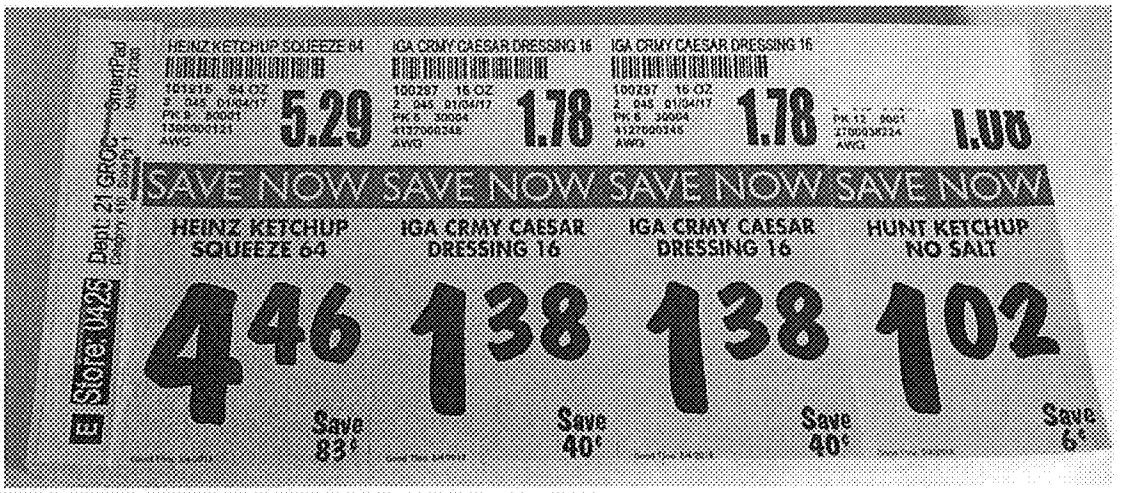
FIG. 33 is the label booklet of FIG. 32 after the first label is removed.
Figure 34:
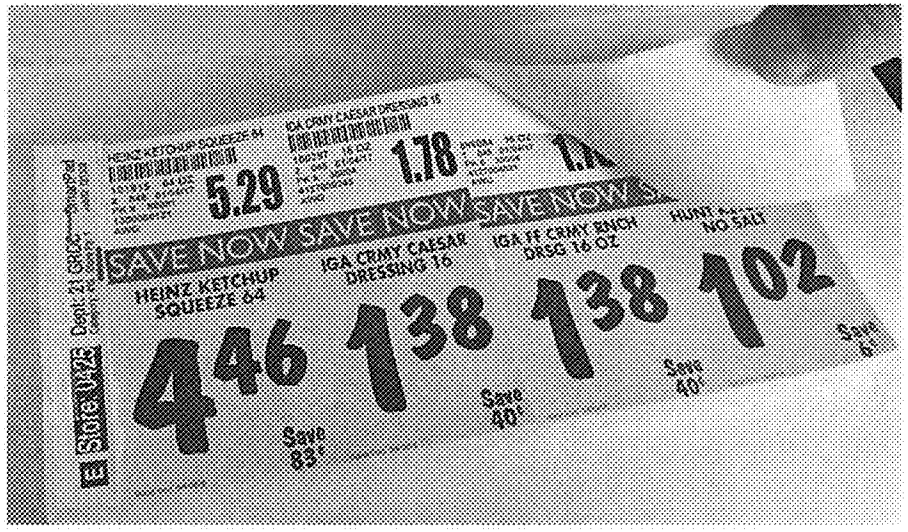
FIG. 34 is the label booklet of FIG. 33 as a second label is being removed to expose more of the liner strip.
Figure 35:
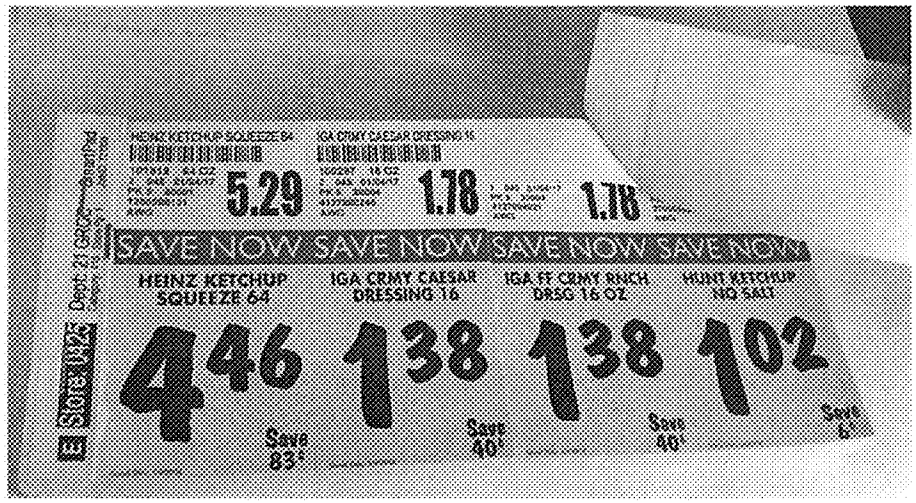
FIG. 35 is the label booklet of FIG. 34 as the second label is almost completely removed from the booklet. The top adhesive is exposed for a user to adhere the label to a retail shelf edge. The labels of the next sheet lying directly below the first and second labels being removed are now exposed.
Figure 36:
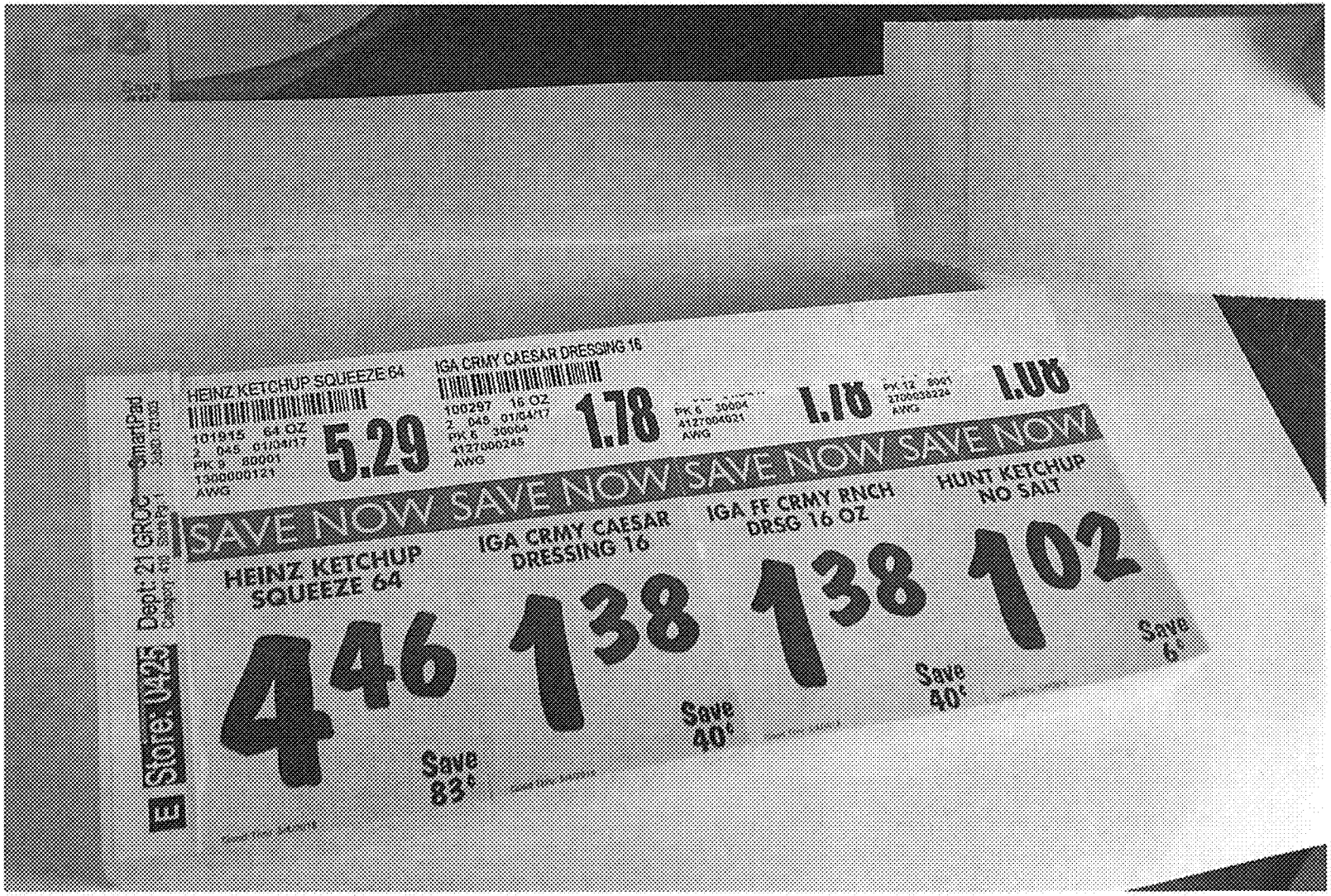
FIG. 36 is the label booklet of FIG. 35 after the second label is removed.
Figure 37:
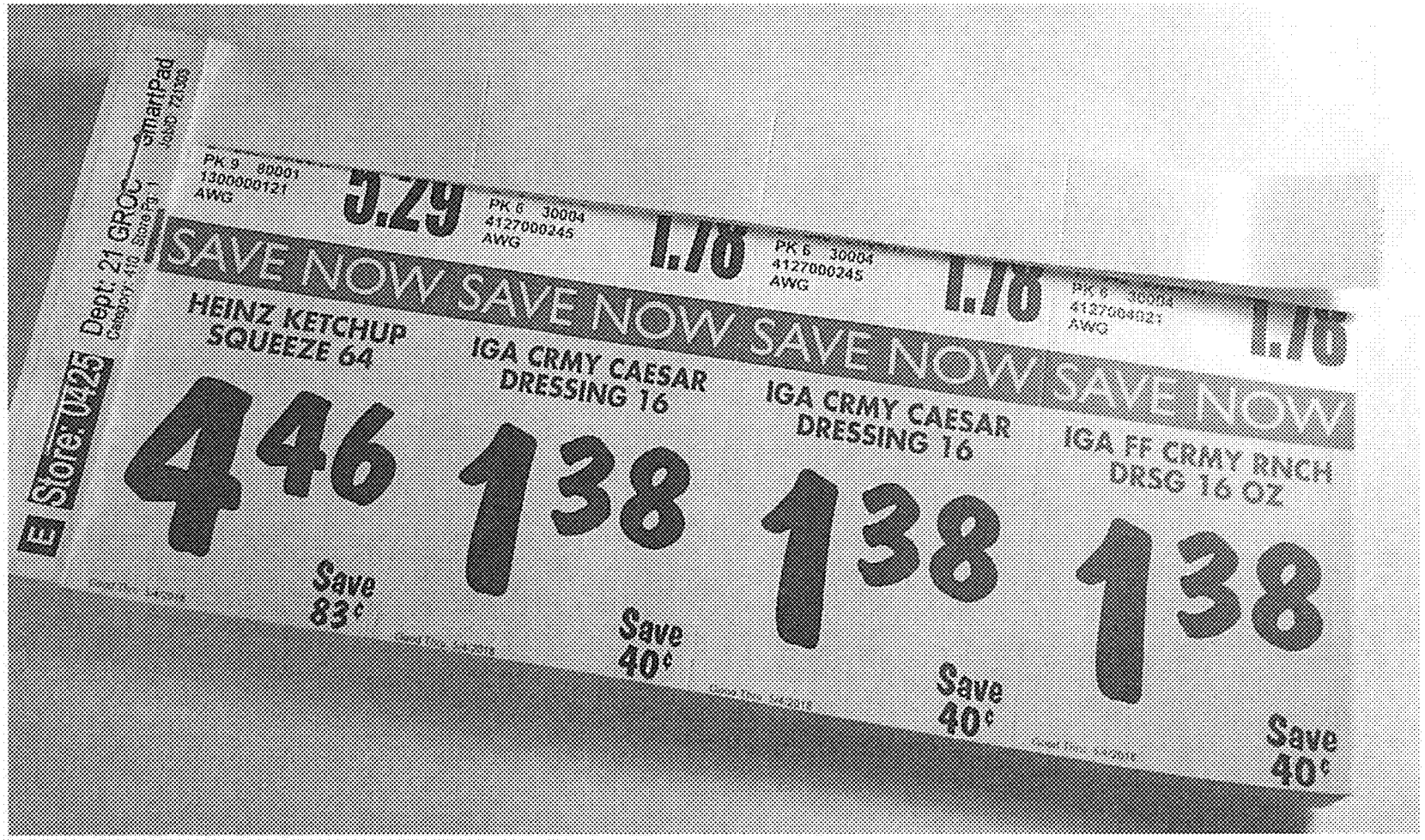
FIG. 37 is the label booklet after two or more rows of labels have been removed from the booklet. The liner strips associated with those rows remain connected to the binding and may be removed if the user desires to do so.

In the first assembled state adjacent label booklets 20 of the plurality of label booklets 20 are removably connected one to another along a shared side length 41T or 41B and removably connected along an end length 38 by a binding 37, the binding 37 forming a respective one end 38 of each label booklet 20 to which the plurality of N sheets 23 is removably connected. The binding 37 spans an entire thickness of each label booklet 20 and an entire combined end 38 length of the label booklets 20. Each label booklet 20 and its respective portion of the binding 37 is detachable from an adjacent label booklet 20 and its respective portion of the binding 37. In the second assembled state each label booklet 20 of the plurality of label booklets are separated from one another. The booklet 20 also may transition between the second assembled state and a third assembled state. See e.g. FIGS. 4, 15, & 21. In the third assembled state, a stack 60 of store labels 27 is separated from the booklet 20 and a remainder of the sheets 23 containing store labels 27 corresponding to those of the stack 60 remain connected to the booklet 20. In a fourth assembled state only the binder 37 remains and may be discarded.

As previously discussed, the store labels 20 may be printed in a predetermined order such as, but not limited to, planogram order or aisle sequence. The sequence of data can be resorted based upon specific customer applications and the label book 10, booklets 20, and labels 27 may be printed in that sequence. For example, in a right-to left reading sequence (with left bind), the labels or tags 27 would be used on each sheet 23 starting from the right and moving to the left, the sequence moving from right to left until hitting the binding, then repeating again on the next sheet 23 and so on. If the binding is on the right, sequence works opposite that as to when the binding is on the left.

Where a stacking sequence may be appropriate, the data sequence may be printed through the sheets 23 as a tag booklet stack 60 from top to bottom/back. So that would mean the first stack a user pulls from the booklet 20 has the data going top to bottom, with the next stack being the same, as well as stacks on top of that or behind, and so on. Because the customer application involves pulling off stacks 60 of sheets 23, a supplier of the label booklets 20 can determine how the labels 27 would stack once removed from the booklet and sequence it accordingly.

Referring now to FIGS. 22 to 37, embodiments of a label booklet 20 of this disclosure may include store labels 27 that "peel off" from a portion 31 of the liner 33 that remains connected to the binding 37. This portion 31 forms a liner strip 61 as each label 27 is removed from its sheet 23. The liner strip 61 may be located toward a top edge or a bottom edge 41T, 41B of the store label 27. When the store label 27 is peeled off from the booklet 20, the adhesive 35*e* is exposed and the label 27 may be adhered to a retail shelf edge. In some embodiments, the entire row of store labels 27 may be removed, leaving a liner strip 61 that extends the entire length of the row (or the entire height of the column depending upon the configuration of the booklet 20). A user may then remove each individual store label 27 from the now-detached row for use on the retail shelf edge. The liner strip 61 may remain connected to the binding 37 as labels 27 of the next sheet 23 are removed from the booklet 20 or the liner strip 61 (or strips 61) can be removed by the user.

To provide a liner strip 61 that remains connected to the binding 37, a back side 47 of each store label 27 is cut through the liner side 33 only at an end portion 69 of the label 27, this backside cut 67 defining the end portion 69 and extending an entire width (or entire height depending on orientation) of the label 27. A front side 45 of the label 27 is cut through the printed stock side 29 only at the end portion 69, this frontside cut 65 running perpendicular to the backside cut 67 and along the shared edge 41S, with its entire length extending the distance between the backside cut 67 to the nearest edge 41T or 41B. The remaining portion 44 of the shared edge 41S not including the back- or frontside cuts 67, 65 is perforated through both the printed stock and liner sides 45, 47 of the label 27 to make a perforated portion 48. Optionally, a tear starter slit 57 may be made toward the end 48*b* of the perforated portion 48, toward the bottom edge 41B. The frontside cut 65 may be a kiss cut forming a slit 63. The frontside cut 65 may also be a perforated cut forming the slit 63 but not extending into the liner 33.

In embodiments, the end portion 69 extends less than half, less than ⅓, less than ¼, less than ⅕, or less than ⅙ of the total height of the store label 27 (or total width depending on orientation). The backside cut 67 may define one boundary of the end portion 42 of the label 27, the frontside cut 65 and its resulting slit 63 lying entirely within the end portion 69, and the perforated portion 48 lying entirely outside the end portion 69.

When a store label 27 is removed from the row—for example, by a user tearing the label 27 from the bottom up along perforated portion 48 farthest from the binder 37—the portion 61*e* of the liner strip 61 lying below that store label 27 is exposed. Another portion 61*c* of the liner strip 61 remains covered by the remaining labels 27 of the row. If the entire row of store labels 27 is removed—for example, by the user removing the row from the bottom up along perforated portion 48 nearest the binder 37—the entire liner strip 61 of that row is exposed. The liner strip 61 remains connected to the binder 37 and a portion 35*e* of the adhesive 35 lying opposite the liner strip 61 is exposed, another portion 33*c* of the liner 33 remains connected to the printed stock side 29, and at least a portion 29*e* of the printed stock side 29 of a label 27 of the next sheet 23 is exposed.

Embodiments of this disclosure that leave a liner strip connected to the booklet provide at least two benefits to the user: (1) minimal waste that is easily handled and (2) significant time savings. First, the embodiments allow a user to not handle a lot of little waste pieces of the liner being pulled off of individual labels when adhering the labels to the shelf edge. By way of example, if the booklet contains five labels or tags per sheet and the user pulls/tear out 20 tags or labels from the booklet, that would be four sheets removed from the booklet. If the liner strip did not stay connected to the booklet, each time the user wanted to hang a tag to the shelf, they would have to remove the small piece of the liner to expose the adhesive strip and then keep that piece of liner in their hand. Each liner tab might be about ¾ inch tall by about 2 inches wide. At the end, the user would have 20 liner tabs in their hand or, most likely, less than that as the liner tabs fall to the ground. Allowing the liner strip to remain connected to the booklet eliminates this problem. While there is some waste—the liner strip and binding—there is a cleaner operation of taking tags from booklet and hanging them without having to hold on to or accidentally drop little waste pieces around. Second, and perhaps more significant, that the embodiments allow for faster operation for the user because they are not having to crack and peel each backslit liner individually per label because that function is already done at the exact same time they remove it from the booklet.

A label book and booklet of this disclosure may include one or more of the following features combined in various ways:

- a binding;
- a location identifier;
- a binding that includes a location identifier;
- a location identifier located, at least in part, on a front side of the binding.
- a location identifier located, at least in part, on a back side of the binding.
- a store label that includes a location identifier or a portion of the location identifier;
- N sheets or pages, with each sheet containing a row or planar array of M labels, where N>1 and $1 \leq M \leq (A_R/A_L)$ or, where label size is not equal, $\leq (A_R/A_{L\ AVG})$;
- sheets containing at least one planar array of store labels arranged in a predetermined order;
- a sheet selected from the group consisting of a paper-based sheet, a laminated paper-based sheet, a film sheet, thermoplastic sheet, and a fabric sheet;
- adjacent store labels of the planar array removably connected to one another along a shared edge;
- at least one store label of the planar array removably connected along one edge to the binding;
- a store label that includes a printed stock side;
- a store label that does not include a liner or adhesive;
- a store label that includes a liner opposite the printed stock side, the liner including a removable portion located toward an edge of the store label, and an adhesive located between the liner and the printed stock side;
- adhesive that covers a portion of the side located toward an edge of the at least one store label;
- a printed stock side that does not include a release coating;
- a back side of the label or liner including a location identifier.
- a printed stock side of one store label containing different product information than at least one other store label of the planar array;
- another planar array of store labels located directly below, and identical to, the at least one planar array;
- an orientation of one store label of the planar array relative to the binding being different than an orientation of at least one other store label of the planar array;
- another planar array of store labels removably connected along a shared edge to the at least one planar array;
- product information contained on the printed stock side of at least one store label of the another planar array being identical to that contained on the printed stock side of an adjacent store label of the at least one planar array;
- product information contained on the printed stock side of at least one store label of the another planar array being different than that contained on the printed stock side of an adjacent store label of the at least one planar array;
- at least one location identifier selected from the group consisting of a store identifier, a department identifier, an aisle identifier, a category identifier, and a planogram identifier;
- a shared edge that is a top edge, a bottom edge, or a side edge;
- a shared edge that includes a perforation;
- a removeable portion of the liner located toward a top edge, a bottom edge, or a side edge of the store label;
- a binding running along at least a portion of an edge of the booklet;
- a binding at a corner of the booklet;
- a binding that includes a paper stock;
- a binding that includes an adhesive.
- a binding that includes one or more mechanical fasteners;
- a binding that includes a plastic binding;
- a binding that is not an adhesive on the face or back of a sheet;
- a binding that is a book-type (glue) binding;
- a binding that is a notepad-type (peel off of) binding;
- a binding that a location identifier on a front side, back side, or on both the front and back side of the binding;
- a binding that does not include a location identifier;
- a tear starter slit (thru-cut, non-perforated) portion at a top, bottom, or both the top and the bottom of each store label;
- the one end of each sheet of the plurality of N sheets removably connected to the edge of the binding including a tear start slit portion at a top, bottom, or both the top and the bottom of the sheet;
- a reference (location) identifier that replaces one or more labels on a first sheet of a label booklet;
- a first, second, third, and fourth assembled state as previously described;
- a liner including a backside cut running perpendicular to the shared edge to define a liner strip located toward another edge of the store label, the backside cut having a depth no greater than that of the liner;
- a printed stock side including a frontside cut running along the shared edge, the frontside cut having a depth no greater than that of the printed stock side and a height no greater than that of the liner strip;

a perforated cut through both the printed stock side and the liner, the perforated cut running along the shared edge to the frontside cut.

The embodiments described in this disclosure are provided as examples of the label book and booklets. The following claims include the full range of equivalents to which each recited element is entitled.

The invention claimed is:

1. A book of store labels comprising:

a binding spanning an entire thickness of the book and including an edge spanning an entire end length of the book;

a plurality of N sheets removably connected at one end to the edge of the binding, each of the N sheets consisting of a planar array of M store labels;

each store label of the planar array removable from an adjacent store label along a shared edge, each sheet being reduced in area as a store label is removed from the planar array;

each store label of the M store labels sharing a liner strip and including:

a printed stock side extending an entire width and length of the store label;

a liner located opposite the printed stock side and extending the entire width and length of the store label; and an adhesive located between the liner and the printed stock side, the liner including a backside cut running perpendicular to the shared edge to define a portion of the liner strip located toward another edge of the store label, the backside cut having a depth no greater than that of the liner; and between adjacent labels of the M store labels:

the printed stock side including a frontside cut running parallel to the shared edge, the frontside cut having a depth no greater than that of the printed stock side and a height no greater than that of the liner strip; and a perforated cut below the liner strip through both the printed stock side and the liner, the perforated cut running parallel to the shared edge to the frontside cut;

wherein when each store label is removed from the book, the liner strip remains connected to the binder and a portion of the adhesive lying opposite the liner strip is exposed, another portion of the liner remains connected to the printed stock side, and at least a portion of the printed stock side of a label of the next sheet is exposed.

* * * * *